US005651193A

United States Patent [19]

Rhodes et al.

[11] Patent Number: 5,651,193

[45] Date of Patent: Jul. 29, 1997

[54] GRAIN DRYER AND CONTROL SYSTEM THEREFOR

[75] Inventors: Virgil O. Rhodes, Ramsey; Timothy P. McDonough, Springfield; Cloyce Newton, Diveron; Victor D. Goeckner, Auburn, all of Ill.; Gary Woodruff, Frankfort, Ind.

[73] Assignee: The GSI Group, Inc., Assumption, Ill.

[21] Appl. No.: 193,710

[22] Filed: Feb. 9, 1994

[51] Int. Cl.[6] ..... F26B 13/10

[52] U.S. Cl. ..... 34/531; 34/535; 34/562; 34/572

[58] Field of Search ..... 34/526, 531, 535, 34/544, 562, 563, 564, 572

[56] References Cited

U.S. PATENT DOCUMENTS

| | | | |
|---|---|---|---|
| 3,056,214 | 10/1962 | Anderson | 34/45 |
| 3,237,315 | 3/1966 | Benecke | 34/65 |
| 3,714,718 | 2/1973 | Sukup | 34/56 |
| 3,946,496 | 3/1976 | Sukup | 34/56 |
| 4,076,492 | 2/1978 | Alms | 432/43 |
| 4,152,840 | 5/1979 | Stille | 34/56 |
| 4,253,244 | 3/1981 | Kranzler | 34/554 |
| 4,356,641 | 11/1982 | Rosenau | 34/537 |
| 4,471,424 | 9/1984 | Persson | 34/535 X |
| 4,583,300 | 4/1986 | Mast | 34/50 |
| 4,599,809 | 7/1986 | Parkes | 34/535 X |
| 4,713,894 | 12/1987 | Roth et al. | 34/562 X |
| 4,750,273 | 6/1988 | Parkes | 34/30 |
| 4,916,830 | 4/1990 | Braun | 34/48 |
| 4,930,229 | 6/1990 | Moser | 34/34 |
| 5,144,755 | 9/1992 | Braun | 34/52 |
| 5,189,812 | 3/1993 | Ediger | 34/54 |

OTHER PUBLICATIONS

Moridge Grain Dryers Models 8330. 8440.
Farm Fans–Move Grain By Air Convey. Air.
Farm Fans–Staged Automatics "Temper. Dry" Grain.
Farm Fans–Automatic Grain Dryers.
Farm Fans. Full Heat Drying CF Series.
American Farm Equipment Co. American Automated Grain Dryers Models 1503T–1706T.
American Farm Equipment Co. American Electronic–Annunciator.
GT Model Rab–5000 Recirculating Automatic Batch Dryer 1987 GT. Inc.
Mathews Company Expandable Continous Grain Dryer D–2119.2.87.
Mathews Company–Models 670–970 Grain Dryers D–2068–7.86.
Mathews Company–Model 375 Grain Dryer Portable Electric Drive Continuous Plow Jul. 1986.
Airstream–Modular Stack Dryer AS01–2.91.

*Primary Examiner*—John M. Sollecito
*Assistant Examiner*—Steve Gravini
*Attorney, Agent, or Firm*—Polster, Lieder, Woodruff & Lucchesi

[57] ABSTRACT

A grain dryer for providing a controlled drying process through a housing. The housing has a path for grain to be dried such that the grain is dried as the grain moves along the path. The grain dryer also has a fan and heater assembly for supplying heated air to the path for drying grain in the path. The grain dryer can control the flow of grain along said path and has sensors disposed in predetermined positions so as to detect different fault conditions. The sensors generating corresponding fault signals in response to the detection of fault conditions. The grain dryer also has a controller operatively connected to the sensors, the controller is responsive to fault signals to initiate a predetermined shutdown procedure upon receipt of any one of the fault signals. A memory is operatively connected to the controller for electronically recording and identifying information concerning shutdown procedures initiated by the controller. The grain dryer controller controls the start-up of in a predetermined manner. The grain dryer includes a memory to store identifying information in memory for a predetermined number of shutdowns initiated by the controller.

26 Claims, 16 Drawing Sheets

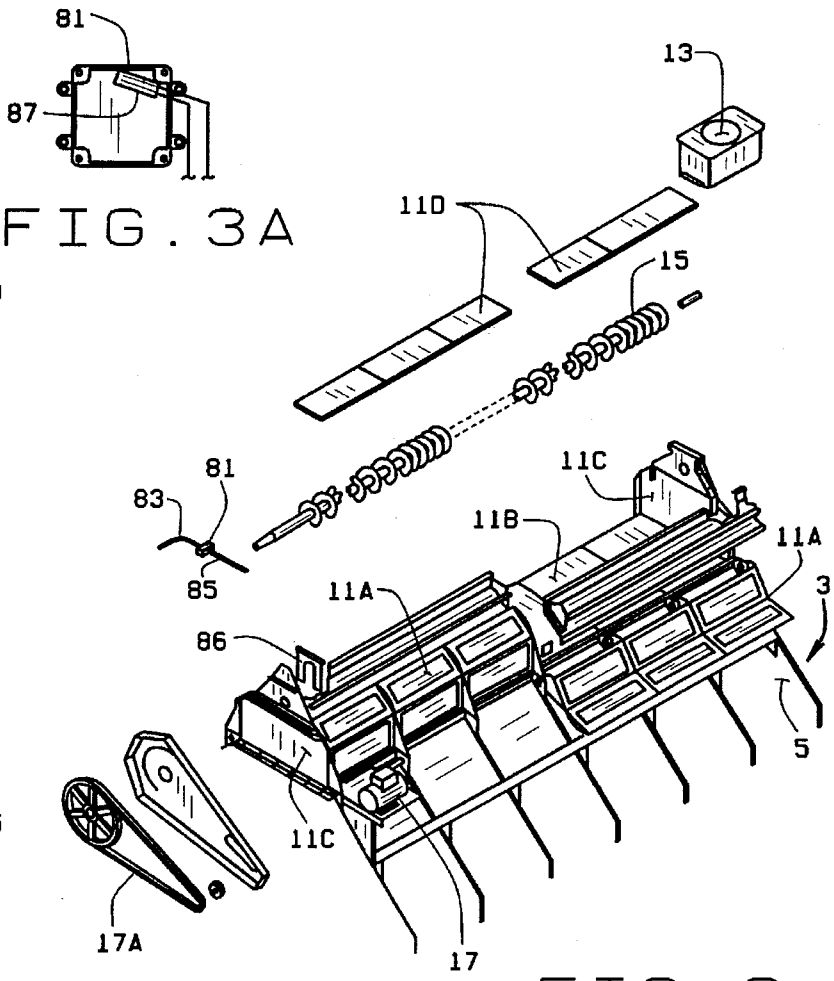
FIG. 3A
FIG. 3
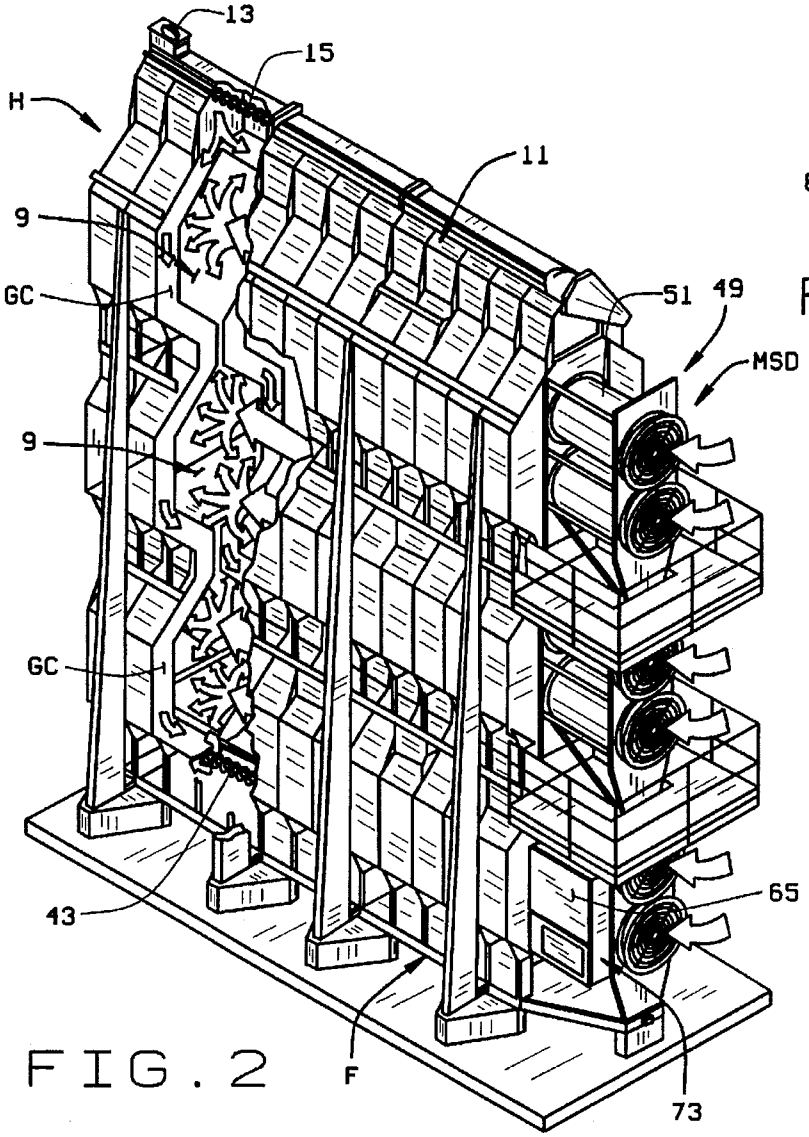
FIG. 2

FIG. 21
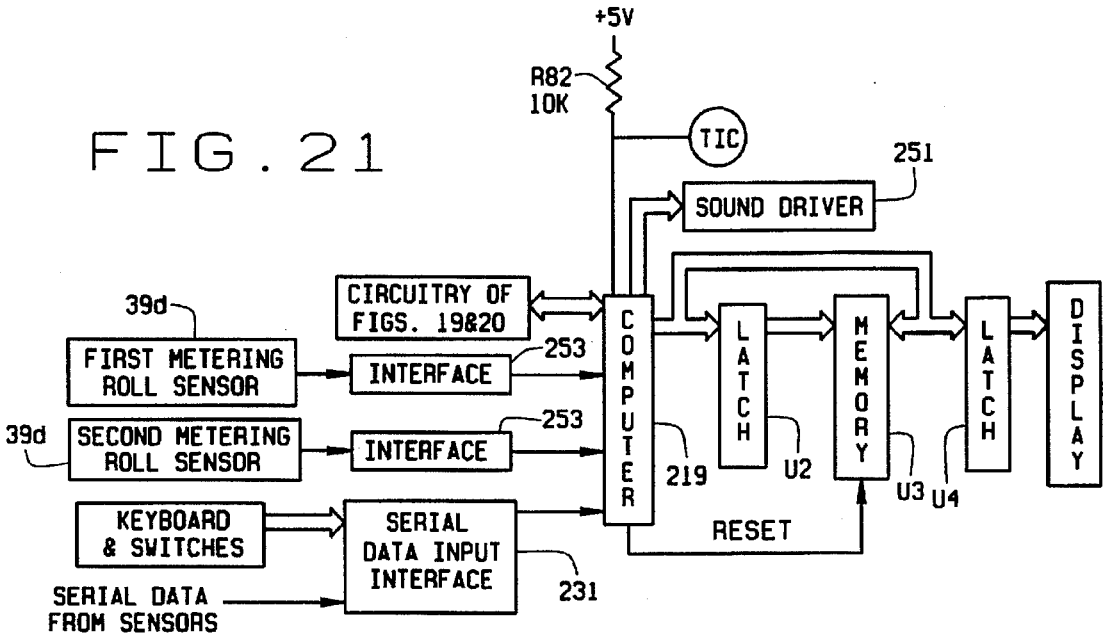
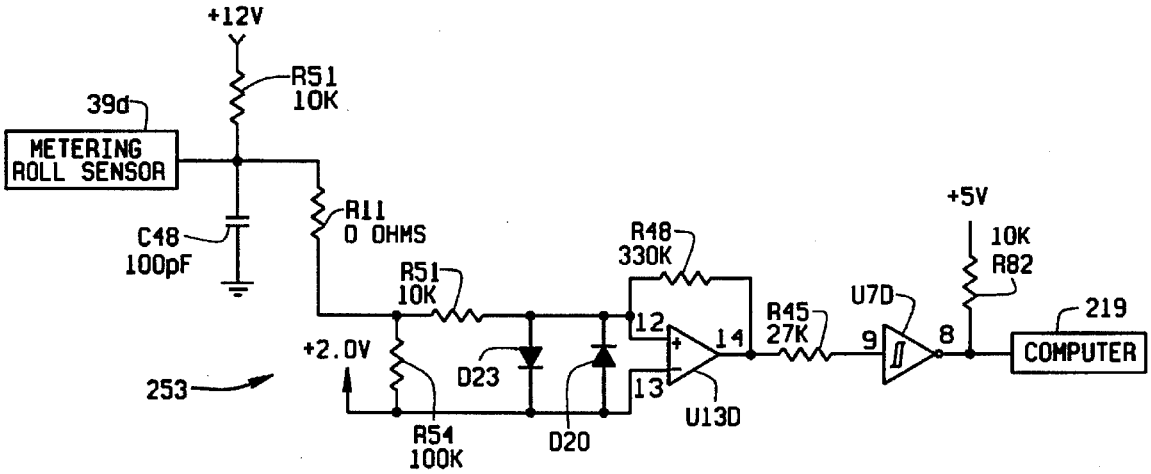
FIG. 21B
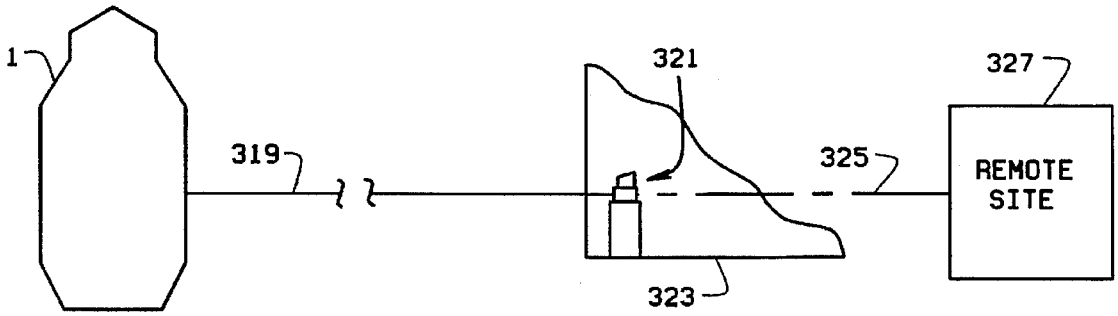
FIG. 23

GRAIN DRYER AND CONTROL SYSTEM THEREFOR

BACKGROUND OF THE INVENTION

This invention relates to a solid state, microcontroller controller for controlling operation of a grain dryer. The controller of the present invention may be used with a variety of grain dryers, but the controller of the present invention will herein be described in conjunction with a vertical flow grain dryer that may be operated in continuous batch, staged automatic, or continuous flow drying modes.

Typically, such a grain dryer comprises a housing having an outer basket of perforate construction and an inner basket also of perforate construction with the inner basket spaced from the outer basket a desired distance (e.g., fourteen inches) so as to form a column of grain to be dried. The wet grain to be dried is delivered to a horizontal garner bin at the top of the dryer. Both the inner and outer baskets are usually concentric relative to one another and are in the form of a vertically disposed diamond shape (when viewed in cross section) such that wet grain from the garner bin is split into two columns, one on each side of the inner basket, by the upper pointed end of the inner basket such that substantially equal quantities of grain flow down the path defined by the grain columns on each side of the inner basket. One or more fans/heater units at one end of the dryer forces heated air into the interior of the inner basket such that the inner basket constitutes a drying or plenum chamber. The heated air is distributed in the plenum chamber and is forced through the perforate inner basket into the grain column to dry the grain in the grain column. The air with the moisture from the grain is discharged to the atmosphere as it passes through the perforate outer basket.

The wet grain is loaded into a garner bin at the top of the dryer by a loading auger or the like. A horizontal auger in the garner bin distributes the grain horizontally such that there is a uniform quantity of grain in the garner bin from one end of the dryer to the other. After the grain has traveled downwardly through the grain column and after it has been dried, the dried grain is discharged from the bottom of the grain column. At the bottom of the grain column, metering rolls are provided which are positively driven so as to control the rate at which dried grain is conveyed from the grain column. The dried grain is discharged into a horizontal grain discharge conduit. The rate of operation of the metering rolls controls the rate of movement of the grain through the dryer and thus regulates the throughput of the dryer. A discharge auger is located in the discharge conduit so as to convey the dried grain from the dryer. The dried grain discharged from the dryer is oftentimes deposited in a pickup well from which it is conveyed to a holding or conditioning bin by way of another auger conveyor.

The fan/heater assembly typically includes an axial flow fan which forcefully draws large quantities of air into a relatively large cylindrical housing and forces the air through the housing and into the drying chamber. (Although the fan is preferably an axial flow fan, centrifugal fans or other types may also be used. Similarly, although a cylindrical housing is primarily used, other housing shapes such as rectangular or square may also be used.) The heater is usually a gas fired burner fueled by liquid propane or the like. The burner is located within the cylindrical housing downstream from the fan such that the fuel is burned within the housing and such that the flame and the products of combustion mix with the air flowing through the housing thereby to heat the air to a desired temperature. In certain models of dryers, only a single fan/heater unit is used. In other dryers, two or three fan/heater units, one on top of the other, are employed. In modular stack dryers, two or even three grain dryers (which need not all be identical) such as above described are stacked vertically one on the other with the grain from the uppermost dryer flowing directly into the grain columns of the next lower dryer with the different dryers being programmed to dry the grain in stages. In fact, because of the ability of the present control system to control different models and sizes of dryers using the same control circuitry, the dryers in a stack can be of very different construction, size, etc. and still be controlled by a single control circuit.

A controller for such a dryer must control operation of the inlet and outlet augers supplying wet grain to the dryer and carrying away dried grain. The controller must also control the operation of the fan/heater units, the upper and lower grain augers, and the metering rolls. The controller must monitor a number of temperature sensors located in various locations within the dryer so as to enable automatic operation of the dryer to dry the grain to a desired moisture level without overheating the grain (which could cause damage to the grain), and must shut down operation of the dryer in the event certain parameters being monitored by the controller are outside limits established for these parameters corresponding to undesirable operating conditions for the dryer.

Prior art dryer controllers typically were analog electromechanical systems. These prior art controllers were difficult and expensive to manufacture, were difficult to reconfigure or change to accommodate different grain drying conditions, which oftentimes required that components (e.g., timers) be physically replaced to change dryer control parameters. Further, the reliability of such electromechanical systems was not at the level that was desired.

Prior art dryer controllers had several shortcomings. For example, in the event a prior art dryer controller would sense a dryer shutdown condition and would shut down the dryer, the controller typically would have a series of indicator lights that would help locate the source of the shutdown. However, in the event of a shutdown, many operators would immediately attempt to re-start the dryer. This re-start procedure would re-set all of the indicator lights so that the operator would not know the likely source of the shutdown (unless the operator either remembered or wrote down the indicator light that was lit) in the event the dryer needed to be serviced.

Prior art controllers would allow all of the motors on the dryer to start simultaneously thus resulting in current draws that may exceed the capability of the electric service available for the dryer. In many dryer installations of a farm or the like, the available electric service may only be 230 volts, single phase power. With prior art controllers, it was necessary for the operator to manually startup the dryer in such manner that only one motor was started at a time to insure that the current draw for the dryer was maintained within the capability of the electric service available. Many operators would not follow proper startup procedures.

Also, prior art controllers could not differentiate between safety related shutdown conditions (e.g., a grain over temperature or detection of a flame) and a non-critical shutdown condition (e.g., an out of incoming grain condition). Difficulty would oftentimes be experienced in that shutdown of the unloading auger would result in the auger becoming jammed, thus requiring a time consuming manual unloading of the dryer or the unloading auger. This necessitated considerable additional work and time required to get the dryer back in operation after a non-critical shutdown.

It will also be appreciated that a manufacturer offering a full line of dryers so as to serve small on-farm drying requirements and large commercial grain storage facilities, a large number of dryer models are necessary. For example, Grain Systems, Inc. of Assumption, Ill. offers about sixty-two (62) models of the above-described grain dryers. With prior art electromechanical controllers, it was necessary to have a different controller for every different dryer model. This presented logistical problems in manufacturing the dryers and also present difficulties in servicing the dryers in the field and in stocking replacement controllers for these dryers.

SUMMARY OF THE INVENTION

Among the objects and features of the present invention may be noted the provision of a controller for a grain dryer in which the components are substantially all solid state and computer controlled such that the reliability, of the controller is increased and the ability to make changes to the operation and the method of control of the dryer may readily and easily be carried out as by changing the software for the micro-controller;

The provision of such a controller in which the startup of the motors in the dryer is staged such that the motors are sequentially started one at a time so as to minimize the current draw requirements of the grain dryer on startup;

The provision of such a controller having a plurality of modes of operation, which controller guides the user in properly setting up the dryer for the particular mode selected and prevents operation of the dryer which is inconsistent with the mode selected.

The provision of such a controller which keeps track of a multiplicity of shutdown events such that a service person or the operator may review a number of the most recent shutdowns of the dryer so that the cause of such shutdowns may be more readily determined and such that the service history of the dryer is better known;

The provision of such a controller which monitors a number of safety devices provided in the dryer and which displays a message such that the operator can determine exactly which safety device was out of limit and caused a shutdown of the dryer;

The provision of such a controller which differentiates between non-safety related shutdowns and safety related shutdowns such that in non-safety shutdowns, the grain in the dryer may automatically be unloaded, thus preventing jamming of the unloading augers and the like so as to minimize the number of times that the dryer must be manually unloaded;

The provision of such a controller which allows the dryer to be set in a continuous batch, automatic staged, or continuous flow mode of operation as desired by the user;

The provision of such a controller which stores many dryer operating parameters and data in memory such that a service technician may readily review the recent operating history of the dryer and thus accurately and quickly diagnose the cause of a problem with the operation of the dryer;

The provision of such a controller which accurately records the amount of grain discharged from the metering rolls such that the drying rate and the throughput of the dryer may be displayed and stored;

The provision of such a controller which detects abnormalities in the operation of the metering rolls;

The provision of such a controller which improves the operation of the metering rolls;

The provision of such a controller which permits the user to initiate an emergency cooling procedure in the event that the grain temperature exceeds acceptable limits;

The provision of such a controller which is capable of controlling a plurality of different grain dryer models without alteration;

The provision of such a controller which includes both hardware and software safety devices;

The provision of such a controller which simplifies the resetting of various dryer parameters to predetermined settings;

The provision of such a controller which is less prone to inaccurate indications of a fault condition;

The provision of such a controller which provides both negative and positive checks on fan operation during fan startup;

The provision of such a controller which controls the dryer normally even during the time changes are being made to the dryer's parameters or the diagnostic history of the dryer is being inspected;

The provision of such a controller which is adaptable to accept signals indicating fault conditions associated with equipment external to the dryer, and to control the dryer in response to said signals;

The provision of such a controller which downloads and stores the setting of various dryer parameters such that in the event of dryer shutdown, or upon the normal startup of the dryer, the operating conditions of the dryer may automatically be returned to these previous parameters; and The provision of such a controller which simplifies operation of the dryer, which is reliable in operation, which is easy to install and which may be readily serviced.

Briefly stated, a grain dryer of the present invention comprises a housing (e.g., the inner and outer baskets) defining a path for grain to be dried (e.g., the grain columns). A fan and heater assembly is provided for supplying heated air to the path for drying grain in the path. Metering rolls are provided for controlling the flow of grain along the path. Sensors are disposed in predetermined positions so as to detect a plurality of fault conditions with the sensors generating a plurality of fault signals in response to the detection of the fault conditions. A controller is operatively connected to the sensors. The controller is responsive to the fault signals to initiate a predetermined shutdown procedure upon receipt of any one of the fault signals. A memory is operatively connected to the controller for electronically recording identifying information concerning shutdown procedures initiated by the controller.

Other objects and features of this invention will be in part apparent and in part pointed out hereinafter.

BRIEF DESCRIPTION OF THE DRAWINGS

FIG. 2 is a perspective view of a modular stack grain dryer comprising three of the dryers shown in FIG. 1 stacked vertically one on the other;

FIG. 3 is an exploded perspective view of the upper portion of the dryer shown in FIG. 1, with parts removed for clarity, illustrating the wet grain inlet and a horizontal garner bin receiving the wet grain and having a horizontal auger therein for distributing grain longitudinally within the garner bin;

FIG. 3A is a perspective of a portion of FIG. 3, illustrating the out of grain sensor;

FIG. 21 is a block diagram illustrating the computerized control circuit of the dryer of the present invention;

FIGS. 21A and 21B are electrical schematics of the circuitry of FIG. 21;

FIG. 23 is a sketch illustrating a further improvement of the control system of the present invention.

Corresponding reference characters indicate corresponding parts throughout the several views of the drawings.

DESCRIPTION OF PREFERRED EMBODIMENTS

Figure 1:
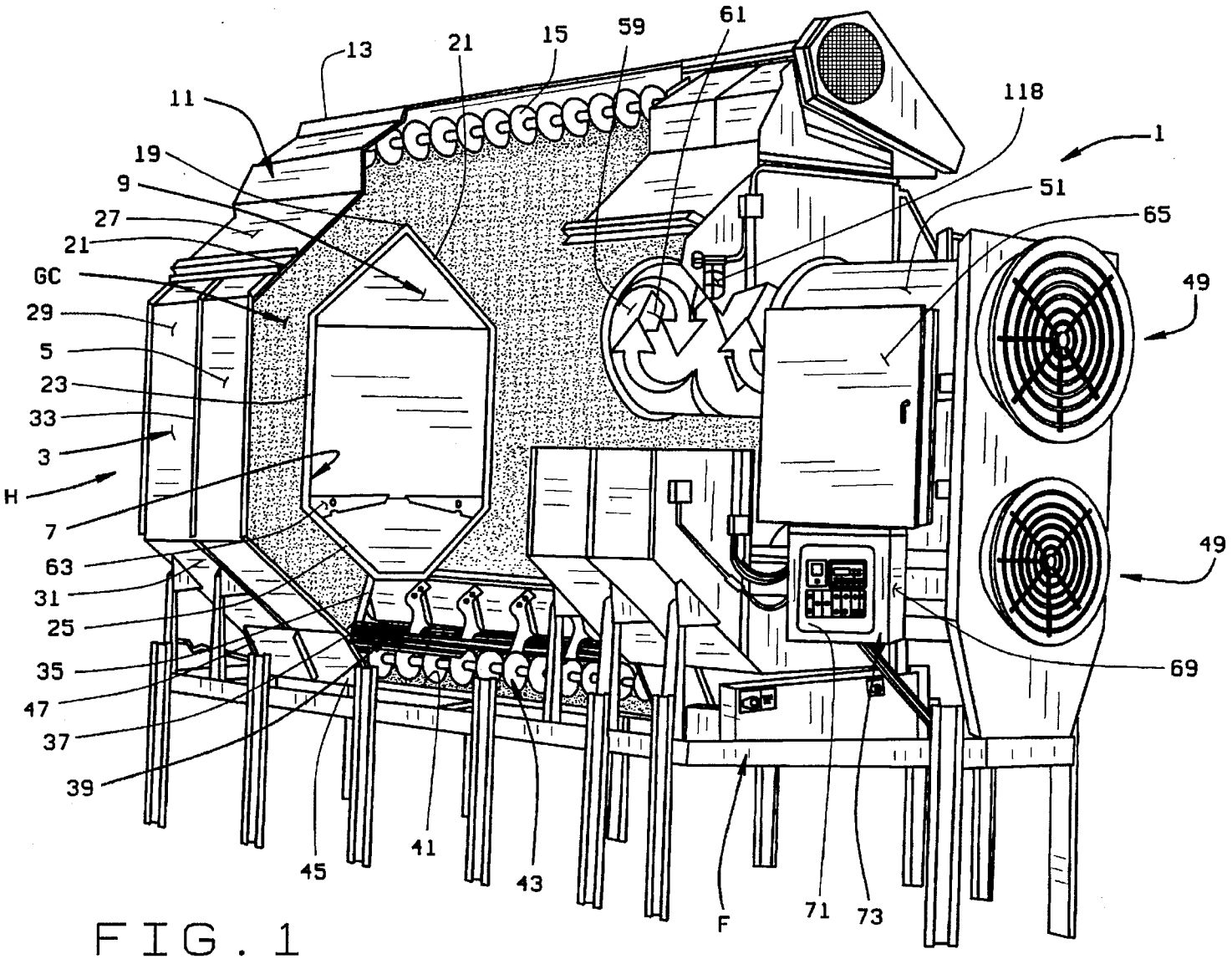
FIG. 1 is a perspective view of a grain dryer having a solid state controller of the present invention.

Referring now to the drawings, a combination grain dryer is indicated in its entirety by reference character 1. As is conventional, dryer 1 is mounted on a frame F which in turn may be mounted on suitable over-the-road wheels (not shown) for the ready transport of the dryer from one site to another. The grain dryer includes a housing H which comprises an outer basket 3 of a series of sheet metal screen panels 5 bolted together in side-to-side abutting relation to form the outer basket. The perforations in the screen panels are sized to permit drying air to readily pass therethrough, but are sufficiently small so as to confine the grain to be dried within the screen panels. An inner basket, as indicated at 7, is disposed within and is generally concentric with outer basket 3. The inner basket is also composed of a series of perforate screen panels with the interior of the inner basket constituting a dryer chamber or plenum 9. At the top of outer basket 3, a horizontally disposed wet grain or garner bin 11 is provided. At one end of the horizontal wet grain bin, a grain inlet opening 13 is disposed, into which a conveying auger (not shown in FIG. 1) is inserted so as to deliver or supply wet grain to be dried in dryer 1. A horizontal top auger 15 is mounted within wet grain bin 11 on oil impregnated hanger bearings in such manner as to be level. Top auger 15 is driven by an auger motor 17 (FIG. 3) via a belt and sheave arrangement 17A.

As shown in FIG. 1, inner basket 7 is generally in the form of a diamond with an apex 19 at the top thereof which serves to divide the flow of wet grain from wet grain bin 11 into two uniform grain columns GC (which defines a path for the grain to be dried) on either side of the inner basket apex and confined between the inner faces of the outer basket 3 and the outer faces on the inner basket. The thickness of the grain column GC is substantially uniform from top to bottom. As shown, the thickness of the grain column is about fourteen (14) inches and the length of the grain column is substantially the full length of the dryer and may range between about fourteen (14) feet up to about twenty-six (26) feet.

More specifically, the inner basket has upper inclined panels 21 diverging downwardly and outwardly from apex 19 and vertical side walls 23 extending down from the outer ends of the inclined panels 21. The inner basket is completed by means of lower converging panels 25 which close the lower regions of the inner basket. All of the panels 21, 23, and 25 of the inner basket are of perforate sheet metal with the openings in the panels sized to permit air to flow therethrough, but are sized to confine the grain as the grain column flows over and around the inner basket as it is dried by heated air emitted from drying chamber 9 in the manner as will be hereinafter described in detail.

Outer basket 3 is generally of the same diamond shape as the above described inner basket 7 having upper inclined panels 27, vertical side panels 29, and lower converging panels 31. This allows for less expensive repairs and permits variations in the material used in the various panels to put more corrosion resistant material in the panels which tend to corrode more rapidly, thereby promoting corrosion resistance while minimizing the attendant cost of the dryer. The panels of both the inner and outer baskets have upstanding flanges 33 thereon such that the flanges of one panel abut with the flanges of an adjacent panel. The adjacent panels are securely fastened to one another by means of bolts inserted through the abutting flanges 33. It will be understood that these panels (along with many of the other components herein described) are preferably made of corrosion (rust) resistant material, such as galvanized sheet steel material. In some applications, it may be preferred that the perforate panels be of suitable stainless steel for added corrosion protection.

Figure 7:
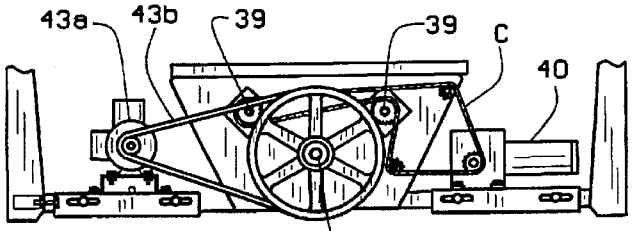
FIG. 7 is an end view of the lower front portion of the dryer illustrating a motor and belt drive for the bottom unloading auger and a SCR motor and chain drive for driving the metering rolls.
Figure 8:
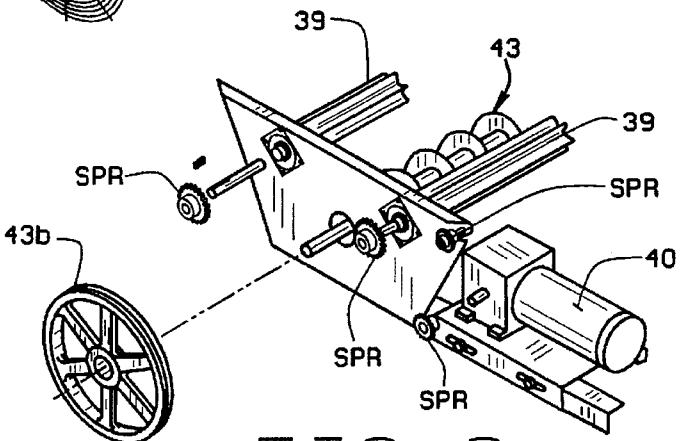
FIG. 8 is an exploded perspective view of the front portion of the dryer shown in FIG. 7 illustrating the metering rolls and the lower auger.

As indicated at 35 (FIGS. 1 and 10), adjustable metering gate panels are provided at the lower reaches of inner basket lower panels 25 to force the grain flowing down the grain columns GC to be discharged from the grain column by way of a grain throat 37. A rotary driven metering roll 39 is disposed within grain throat 37 for positively discharging a known quantity of grain upon each revolution of the metering roll. Each metering roll 39 is preferably driven by means of a suitable variable speed dc motor 40, controlled by a silicon controlled rectifier control circuit SCR, and a chain and sprocket drive C (as shown in FIGS. 7 and 8). Chain and sprocket drive C includes a plurality of sprockets SPR designed in conventional manner to drive the metering rolls at the rate set by the motor 40. The means of attaching the sprockets to the metering rolls and to the motor is conventional as well.

Figure 10:
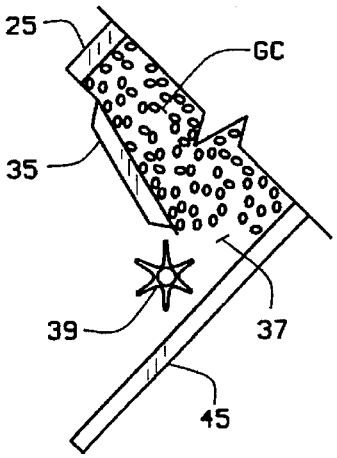
FIG. 10 is a cross-sectional view of one of the metering rolls illustrating the flow path of the grain from the grain column, through the metering roll, and into the grain discharge conduit for being transported from the dryer via the unloading auger.
Figure 11:
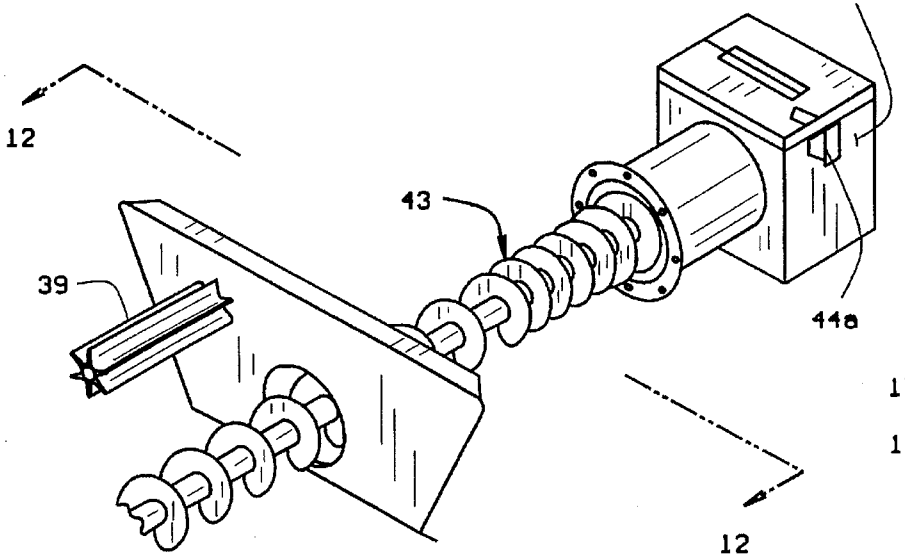
FIG. 11 is an exploded perspective view of the rear end of the unloading auger illustrating a grain discharge box which receives grain from the unloading auger, the grain discharge box having a hinged lid which is monitored by a microswitch, constituting an auger limit switch for terminating operation of the auger in the event the discharge box becomes overloaded with grain, forcing open the hinged lid.

Each metering roll 39 is a star-shaped roll (as best shown in FIGS. 10 and 11) of hardened, extruded aluminum having a plurality of teeth (e.g., six teeth) extending radially therefrom with the teeth extending lengthwise of the metering roll. Each time the metering roll is rotated, the space between adjacent metering roll teeth is filled with grain when the space faces upwardly into the grain column. As the metering roll is rotated, the grain carried within the space between adjacent teeth of the metering roll is carried with the metering roll and is dumped into a grain discharge conduit 41 below the metering rolls. Thus, upon each revolution of the metering rolls, a predetermined volume of grain is metered from the grain column and is discharged into the discharge conduit. Metering gates 35 are adjusted relative to metering rolls 39 such that grain does not flow past the metering rolls. As a result the only way for grain to be discharged from the grain column GC into the discharge conduit is for the grain to be positively metered by the metering rolls upon rotation thereof. Thus, metering rolls 39 and the variable speed motor 40 constitute means for controlling the flow of grain through the grain column GC and for controlling the rate at which grain is discharged from dryer 1 and into the discharge conduit 41. The drive mechanism for the metering rolls preferably includes suitable means for reversing the direction of rotation of the metering rolls. The control circuit is programmable to reverse the direction of rotation of the metering rolls at preset intervals. For example, the control circuit may be programmed to reverse the direction of rotation of the metering rolls for five minutes during each three hours of operation. This feature prevents fines from building up in the corresponding grain columns GC, which would otherwise slow the flow of grain and potentially cause an overheated condition in the grain column.

Figure 10A:
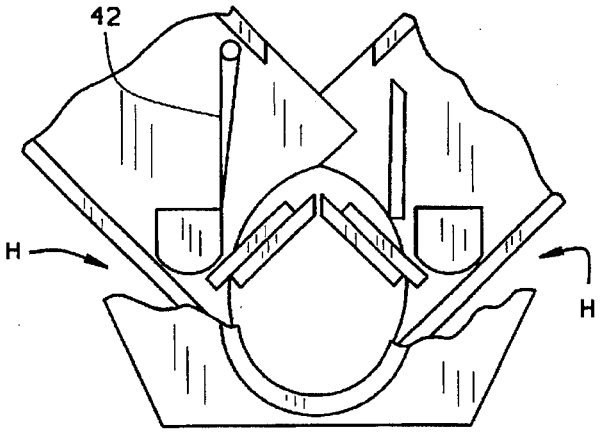
FIG. 10A is a view similar to FIG. 6 showing an alternative construction of the lower portion of the grain dryer of the present invention.
Figure 12:
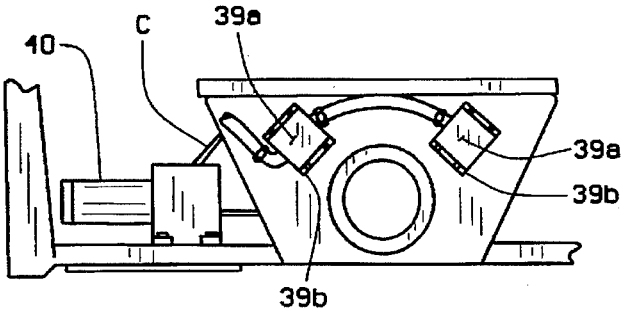
FIG. 12 is a view taken along line 12—12 of FIG. 11 illustrating the rear ends of the metering rolls and showing a sensor for each of the metering rolls for monitoring operation of the meter rolls.
Figure 13:
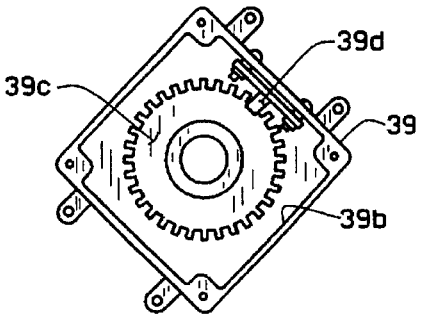
FIG. 13 is an enlarged view of one of the metering roll sensors with the cover removed showing a slotted wheel mounted on and rotatable with the metering roll and an optical encoder for generating a signal in response to rotation of its respective metering roll.

At the rear end of dryer 1, metering roll sensors, as generally indicated at **39*a*, are mounted for sensing rotation of metering rolls 39 and for generating corresponding signals in response to rotation of the metering rolls. As shown in FIG. 12, the rear ends of the metering rolls are enclosed within a sensor box 39*b*. In FIG. 13, the cover has been removed from sensor box 39*b* to illustrate a slotted wheel 39*c* mounted for rotation with its respective metering roll 39. An optical encoder 39*d* is mounted within the sensor box which generates a pulse signal each time one of the teeth on wheel 39*c* breaks a light beam. The encoder then sends these signals to the controller for purposes that will hereinafter appear. It should be understood that although it is preferred for many applications to include metering rolls 39 to meter the discharge of the grain, the present invention is not so limited. For example (see FIG. 10A—sheet 6), the metering rolls may be completely removed and the grain allowed to fall into the discharge conduit 41. In this embodiment, the presence of grain as the dryer starts to fill is sensed by a paddle switch 42**. The paddle switch continues to sense grain until the dryer is almost completely unloaded, at which point it signals the unloaded condition of the dryer to the control circuitry.

An unloading auger conveyor 43 (FIG. 11) is provided in discharge conduit 41 for conveying or transporting the dried grain horizontally from the rear end of conduit 41 into a grain discharge box 44. The latter has an auger limit microswitch **44*a* mounted therein for determining when a predetermined excessive amount of grain is in the grain discharge box. Normally a user supplied transport auger or conveyor (not shown) is used to convey away grain from the dryer to a grain storage bin or the like (not shown). Whenever a problem occurs in this take-away system, the grain backs up in grain discharge box 44, which pushes open the lid of the box. When the lid opens, this opens the contacts of microswitch 44*a*. The control circuit is responsive to this signal to shut down the dryer. Microswitch 44*a* may be a model ZCK-L1 switch from Bodine. Thus, the unloading auger 43 constitutes means for transporting or conveying the dried grain from the dryer. As shown best in FIG. 7, the unloading auger 43 is driven by a motor 43*a* via a belt and pulley drive 43*b***.

Turning back to FIG. 1, at the lower reaches of outer basket panels 31, clean out doors 45 are provided which may be opened to allow access to metering rolls 39 and to unloading auger 43. It will be understood that the end of the discharge conduit through which the dried grain is discharged (i.e., the left-hand end, as shown in FIG. 1) constitutes a grain discharge outlet 47.

As generally indicated at 49, grain dryer 1 is provided with at least one fan/heater assembly. In the dryer illustrated in FIG. 1, two such fan/heater units 49 are provided stacked one on top of the other. It is preferred that when more than one fan assembly is used, that the larger fan assembly be mounted above the smaller fan assemblies. Other similar grain dryers may have but a single fan/heater 49 or it may have three (3) fan/heater assemblies.

Figure 6:
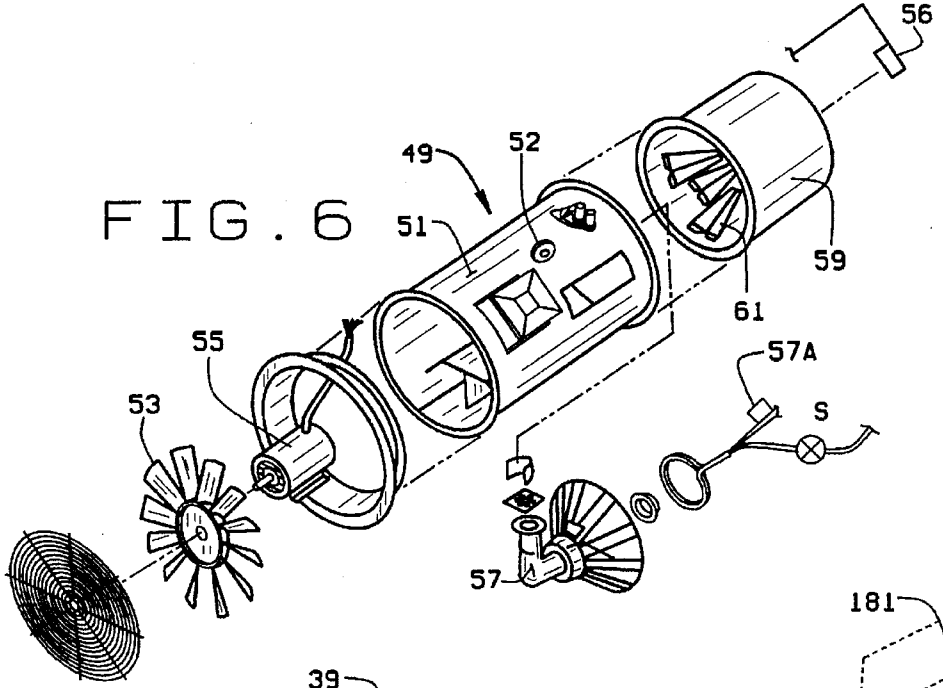
FIG. 6 is an exploded perspective view of a fan/heater assembly.

As shown in FIG. 6, each of these fan/heater units comprises a housing 51 having an intake end in communication with the atmosphere and a discharge end in communication with drying chamber 9 within inner basket 7. Although the housing is shown as cylindrical, other shapes such as rectangular or square could be used as well. Each housing has a temperature limit sensor 52 disposed thereon, suitably connected to the control circuit by an electrical connection not shown. When the temperature of the housing exceeds a predetermined limit, the sensor 52 provides a signal to the control circuit, which in response shuts down the dryer. For example, a Model 2E364 sensor from W. W. Grainger may be used as sensor 52.

A fan 53 is mounted within housing 51 proximate the intake end thereof. Fan 53 is preferably an axial flow fan driven by an electric fan motor 55 also located within the fan housing. Alternatively, other fan types such as centrifugal fans may be used instead. At the opposite end of the housing from the fan is disposed an air switch sensor 56 for sensing whether air is flowing from the fan. Such sensors may be either velocity or pressure sensors, as desired.

A burner 57 is mounted within housing 51 downstream from fan motor 55. This burner burns a suitable fuel, such as vaporized liquid propane, fuel oil, or natural gas, so as to form a flame within housing 51 for heating the airstream flowing through the housing. Of course, other forms of heater units (such as electric heaters) could be used instead, depending upon the requirements. As shown in FIG. 6, the flow of vaporized propane to burner 57 is controlled by a solenoid valve S which in turn is controlled by the control system for the dryer in a manner described hereinafter. A sensor 57A is also disposed along the propane line to sense when the temperature of the vapor exceeds a predetermined limit. This sensor is also connected by a suitable electrical connection (not shown) to the control circuit. When a high vapor temperature condition occurs, the control circuit in response to the signal from sensor 57A shuts down the dryer. Sensor 57A may be, for example, a Model 3000-563-TBD sensor from Elmwood Sensors.

The heating capacity of these burners may range from about 3.5 Million BTU/Hr. to about 10.25 Million BTU/Hr., depending on the size of the dryer and the burner. The flame mixes with the airstream flowing through housing 51 and thus heats the air flowing through housing 51.

The heated air and the products of combustion (primarily carbon dioxide and water vapor) are mixed with the airstream downstream from housing 51 in an air mixing chamber 59 (see also FIG. 1) having air mixing vanes 61 therein. The mixing chamber 59 receives the airstream from the discharge end of housing 51 and the vanes 61 thoroughly mix the air and the products of combustion before this mixture is released into drying chamber 9. Although the mixing is shown as circular in FIG. 1, it should be understood that the mixing is actually quite turbulent. The fan and the burner above-described are conventional.

Drying chamber or plenum 9 has dividers 63 (FIG. 1) therein which divide the drying chamber into different heating zones. The fan/heater units 49 may thus be controlled so as to provide heated air of a desired temperature and flow rate to the various zones within the drying chamber such that the air discharged from the drying chamber, through the perforated panels comprising the inner basket and into the grain column GC, dry and condition the grain in a desired manner as will be hereinafter described.

As shown in FIG. 2, two or even three of the dryers 1 may be vertically stacked one on the other to form a modular stack grain dryer MSD in which grain to be dried is loaded into the wet grain bin 11 of the top dryer and then the various fan/heater assemblies 49 of the stacked dryer are controlled to dry the grain in accordance with predetermined heating zones as the grain travels downwardly in the grain columns GC of the various dryers. It will be understood that in a modular stack dryer that only the bottom dryer 1 need be provided with metering rolls 39. The drying capacity of grain dryers as herein described may vary between about 120 bushels of shelled corn/hour for a single stage, low capacity single fan dryer (such as a Model 1108 dryer commercially available from Grain Systems, Inc. of Assumption, Ill., the assignee of the present invention) and about 4,100 bushels/hour for a high capacity modular stack dryer MSD having three (3) vertical dryer modules and six (6) fans (such as a Model 3626 illustrated in FIG. 2 also commercially available from Grain Systems, Inc.).

A weatherproof electrical panel box 65 (FIG. 1) contains circuit breakers and switches for supplying electrical power to the various motors powering the augers, metering rolls and fan/heater units of grain dryer 1. This panel is adapted to be connected to power lines via a service line (not shown). It will be understood that, depending on the electrical service available at the site where the dryer will be operated, the electrical power may be 230 volt single phase, 230 volt three phase, or 440 volt three phase power. At many farms where dryer 1 will be used, the available power is 230 volt single phase power. It will be noted that the current draw for such dryers may vary considerably. For example, for the Model 1108 dryer described above, it has a steady state current draw of about 62 amps if connected to 230 volt single phase power or about 36 amps if connected to 230 volt three phase power. The larger Model 3626 dryer has a steady state current draw of about 352 amps if serviced by 230 volt three phase power or 176 amps if serviced by 440 volt three phase power. It should be understood that the voltages needed by the various motors and control circuitry may differ from the supply voltage, in which event those voltages may be stepped down to the desired voltage level by conventional means.

It will be understood that if the various electric motors of dryer 1 are started simultaneously, the startup current draw for these motors could be considerably higher and may exceed the capability of the power service. It will be further understood, that a manufacturer of grain dryers, such as above described, must furnish a wide range of models to meet the needs of small grain farmers for on-farm drying to large commercial grain dealers who must dry large quantities of grain in short times as the wet grain is delivered from the field. For example, Grain Systems, Inc. offers approximately sixty-two (62) different models of grain dryers.

The solid state electronic control circuitry of the present invention is provided within a weatherproof cabinet 69 (FIG. 1) having a transparent panel 71 through which the user/operator of dryer 1 may monitor various dryer operating parameters without having to open the cabinet. The circuitry, described below, includes (see FIGS. 4 and 5) a control panel 73 which has various manually operable input devices (described below) and an alpha-numeric display 75 mounted within cabinet 69. The control panel and the display panel will be described hereinafter. Both the control panel 73 and the electrical panel box 65 are mounted on the front of dryer 1 for ready access by the operator. Suitable electrical connections are made between panel box 65 and cabinet 69, as described below.

Turning to FIG. 3, it can be seen that garner bin 11 has sides 11A, a floor 11B, ends 11C, and a top 11D, which define the conduit through the bin. Auger 15 is driven by motor 17, through belt and pulley drive 17A, to transport grain from bin opening 13 along the conduit to cause the grain to fall into grain columns GC. It should be appreciated that auger 15 operates to fill the garner bin conduit with grain until the conduit is full. At that point it ceases operation until the grain level falls a predetermined amount. More particularly, the control circuitry is responsive to signals from a sensor housing 81 to control motor 17 to function in this way. Housing 81 is electrically connected by an electrical cable 83 to the control circuitry (described below). The housing is mechanically attached to a switch shaft 85 which in use is disposed across the end of the garner bin conduit. The shaft carries a downwardly extending grain paddle 86 which is in contact with the grain in the garner bin. As the level of grain in the conduit increases, the paddle 86 is moved upwardly by the grain and rotates shaft 85 in one direction, and as the level of the grain in the garner bin decreases, the switch shaft moves in the other direction. The shaft is rigidly mounted to the housing so that movement of the shaft causes corresponding movement of the housing. As shown in FIG. 3A, housing 81 has a mercury switch 87 fixedly mounted thereto, so that movement of the housing to a predetermined position causes switch 87 to send a signal to the control circuitry that the grain has reached corresponding predetermined level. In particular, mercury switch 87 is the out of grain sensor, which signals to the control circuitry that the garner bin needs grain.

Figure 4:
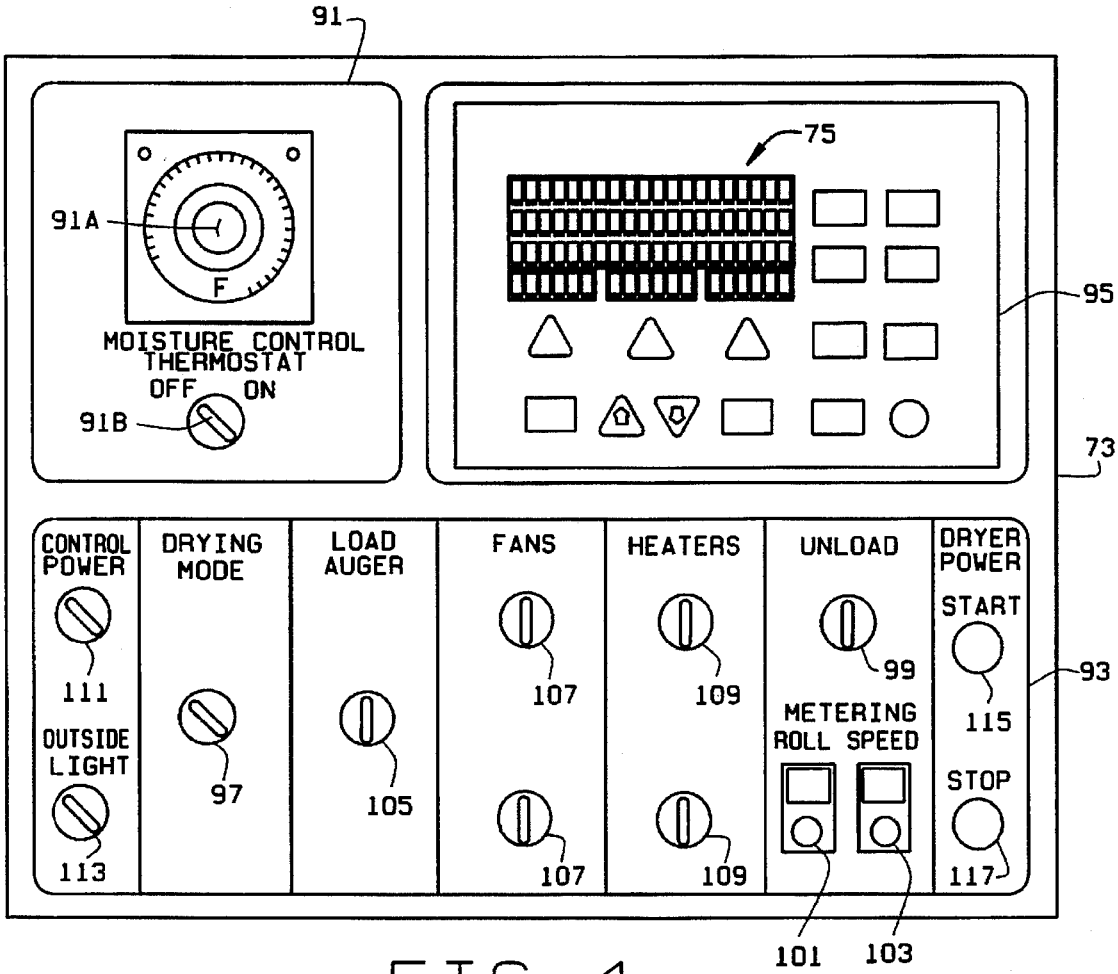
FIG. 4 is a front view of the control panel for an electronic controller for controlling operation of the dryer.

Turning to FIG. 4, control panel 73 includes a moisture control portion 91, a control switch/potentiometer section 93, and a display/membrane switch section 95. Moisture control portion 91 includes a moisture control thermostat 91A and an on/off switch 91B. The moisture control thermostat preferably controls the discharge grain moisture from the dryer by sensing grain column temperature, using grain column temperature sensors described below. By adjusting the setting on thermostat 91A, the user may adjust the desired moisture level of the dried grain exiting from the dryer. The control circuit is responsive to the setting on the thermostat and to the grain column temperature to control the metering rolls 39 to prevent the grain from exiting the dryer until the desired moisture level is reached. The way in which this is done depends upon the mode of operation of the dryer.

The grain dryer has a number of modes of operation, and a number of user selectable speeds of operation. For example, a user operable switch 97 is used to select the drying mode of the dryer. The possible selections are "Staged Batch" and "Continuous Flow." The control circuit is responsive to this switch setting to control the dryer to operate in the selected mode. In a similar manner, an unload switch 99 is used to signal the control circuit whether "1 Speed" or "2 Speed" operation of the metering rolls 39 is desired. When the drying mode switch 97 is set for "Continuous Flow" and the unload switch is set for "2 Speed" operation, the control circuit is responsive to the moisture control thermostat setting and to the grain column temperature to switch the metering rolls 39 between the low and high speeds as a function of discharge moisture. If the grain moisture (as indicated by the grain column temperature) is increasing above a level corresponding to the desired moisture level, the low speed of metering rolls is used. As the moisture level decreases, the metering rolls are switched to the high speed of operation. In this situation, the discharge auger 43 is controlled by the control circuit to operate continuously.

The user can select the actual high and low speeds of the metering rolls 39 by using a pair of potentiometers 101, 103. The control circuit is responsive to the user entered setting on the potentiometers to control the metering rolls to operate at the corresponding speeds. More particularly, the low speed setting on potentiometer 101 determines the low speed of metering rolls 39 only when the two speed automatic moisture control feature of the dryer is utilized. The high speed setting is used in four situations. The first is during the two speed automatic moisture control mode of operation, described above. The second is when the unload switch is set in the "1 Speed" position, that one speed of operation being the speed set by high speed potentiometer 103. In this situation, the control circuit is responsive to the moisture control thermostat setting and the grain column temperature to switch the metering rolls either on to the setting of the high speed potentiometer 103, or off, depending on the grain moisture. The third is when the dryer is operating in continuous mode and the moisture control is not used. The fourth is when the grain is being discharged from the dryer during the unload cycle of staged batch dryer operation. In this mode of operation, the control circuit is responsive to the moisture control thermostat 91A setting to hold the grain in the dryer until the desired moisture content is reached. When the grain is dried to the desired setting, the control circuit controls the metering rolls to unload the dryer at the high speed set on potentiometer 103.

The switch/potentiometer section 93 also include a manually operable switch 105 for selecting the mode of operation of load auger 15. This switch has an "Off" position, and two mode positions, "Auto" and "Manual." The control circuit is response to switch 105 being in either the "Auto" and "Manual" positions to operate load auger 15 whenever the dryer is low on grain and to automatically shut off the load auger when the dryer is full. The control circuit determines these conditions from mercury switch 87 in the garner bin, described above. When the switch is in the "Auto" position, the control circuit also shuts the entire dryer down if the flow of grain to the dryer is interrupted. This condition is evidenced by mercury switch 87 providing the "needs grain" signal for a preset period of time. That preset period of time is selectable by the user, using a set of membrane switches described below in connection with FIG. 5. Note, as described below, that the first time the mercury switch senses the need for grain at startup of the dryer there is no delay. It is only after the garner bin has been filled the first time that the time delay is used to prevent too rapid recycling of the load auger. If user provided auxiliary equipment is being used with dryer 1, load auger switch 105 can also be used to control operation of the auxiliary equipment in the same manner.

Each fan 53 has a corresponding fan switch 107 disposed on panel 73. Each switch has an "Auto" position, an "Off" position, and an "On" position. In FIG. 4, two such switches are shown, the upper one for the upper fan and the lower one for the lower fan in FIG. 1. When the switches are in the "On" position, the control circuit controls the fans to operate continuously. The control circuit is responsive to the switches being in the "Auto" position to operate the fans continuously except when the dryer is in the unload cycle of staged batch dryer operation.

Similarly, each heater 57 has a corresponding heater switch 109, having an "Auto" position, an "Off" position, and an "On" position. The control circuit is responsive to each heater switch being in the "On" position to cause the corresponding heater to operate whenever its associated fan is operating. In the "Auto" position, the control circuit causes the burner to operate only during the dry cycle of staged batch operation.

It should be noted, as discussed below, that the control circuit of the present invention controls all aspects of the fan and heater operation. Starting, operation, and monitoring of the fans and heaters are all under direct control of the control circuit, as will appear. Operation is controlled automatically in accordance with the program preset for that particular model of dryer in the control circuit. Even the response of the fans and heaters during the various shutdown procedures is preset, so that even the shutdown procedures are automatic, requiring no operator intervention.

Panel 73 also includes a "Control Power" switch 111, and "Outside Light" switch 113, a "Start" switch 115, and a "Stop" switch 117. The control power switch 111 is used to turn power on and off to the control circuitry. The outside light switch is used to turn on and off an external illumination device 118 (FIG. 14) mounted for the user's convenience on the dryer. The light switch also has an "Auto" position in which the light in on whenever the dryer is operating. The control circuit turns off the light upon shutdown of the dryer. It therefore functions as a remote indicator of dryer operation. The start switch 115 is used to energize the control circuitry. When this switch is depressed, the dryer starts up and operates based on the other control panel switch settings. If the other switches are in the "Off" positions, the individual dryer components may be operated by first depressing the start switch and then turning on the switch for the individual dryer component.

The stop switch is used to stop all dryer functions. In the event of an automatic dryer shutdown (described below), stop switch 117 must be pressed to reset the dryer control circuit before the dryer can be restarted.

Figure 5:
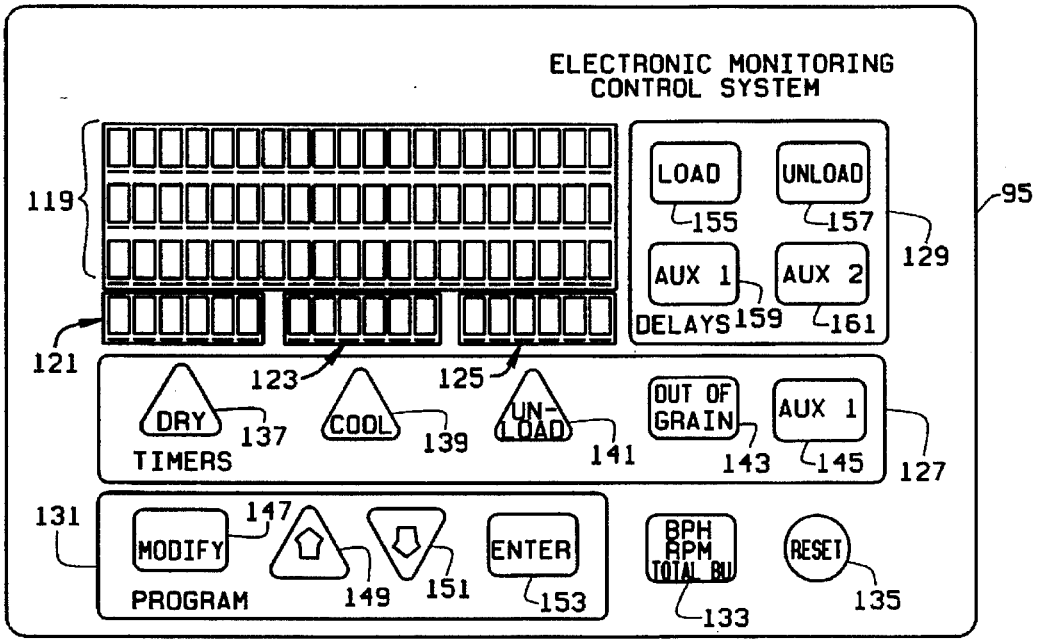
FIG. 5 is an enlarged view of the display panel of the controller.

Also shown in FIG. 4 is the display/membrane switch portion 95, shown in more detail in FIG. 5. This portion of the control panel includes a three line, multi-character liquid crystal (LCD) display 119 for displaying messages and other information, three LCD displays 121, 123, 125 for displaying timer information, a set of timer membrane switches 127, a set of delay membrane switches 129, a set of program membrane switches 131, a total bushels membrane switch 133, and a reset membrane switch 135. It is preferred that LCD displays 119, 121, 123, and 125 be part of a single four line, twenty character per line display, suitably masked off as indicated. To energize the switches of portion 95, the user turns control power switch 111 (FIG. 4) to the "On" position. When this occurs, the control circuit causes the total running hours of the dryer and the current time and date and model of the dryer to be displayed in display 119. Display of the model of the dryer allows verification that the correct control software for the control circuit is enabled. The control circuit itself is activated by the user pressing reset membrane switch 135.

The control circuit of the present invention has five built in timers, labeled "Dry", "Cool", "Unload", "Out of Grain", and "Aux 1." These timers have associated therewith membrane switches 137, 139, 141, 143, and 145, which the user may operate to set the associated timers. The control circuit is responsive to these switches to set the corresponding timers in the conventional manner. The Dry, Cool, and Unload timers are used to set the cycle times in the "Staged Batch" mode only. To use and display the settings on these three timers (in displays 121, 123, and 125 respectively), the "Drying Mode" selector switch 97 must be in the "Staged Batch" position. If it is, the control circuit causes the current settings on these three timers to be displayed in the display (121, 123, 125) disposed above the corresponding timer membrane switch.

To change the setting of these timers, the user must press the desired Dry, Cool or Unload timer membrane switch, press a program membrane switch 147 labeled "Modify", and then press either a program membrane switch 149 labeled "Increase" or a program membrane switch 151 labeled "Decrease" until the desired setting appears in the corresponding display (121, 123, 125). The control circuit is responsive to the increase and decrease switches to change the display of the setting accordingly until the actuated switch is released. Once the desired setting is displayed, the user presses a program membrane switch 153 labeled "Enter." The control circuit in response changes the setting of the corresponding timer to that displayed in the corresponding display.

The user is not required to remember this procedure for changing timer settings. Once the desired timer membrane switch is pressed, the control circuit causes messages to be displayed on display 119 to guide the user through the procedure.

Displays 121, 123, and 125 also have another function. During dryer operation, the time remaining on each timer is displayed on the corresponding display. Should power be lost to the dryer or should the dryer be stopped, the control circuit keeps those times in memory. Upon restart of the dryer, the timers continue timing down from those stored times. The user can set each timer to its initial setting by pressing the reset switch 135. The control circuit in response resets all timers to their initial values.

The out of grain timer, associated with membrane switch 143, causes the control circuit to automatically shut off dryer 1 after the period of time set on that timer should the dryer run low on grain. Before this feature is enabled, the load auger switch 105 must be in the "Auto" position. The procedure to change the setting of this timer is the same as that described above in connection with the Dry, Cool, and Unload timers.

In addition to the timers, the control system of the present invention has four delays, associated with four delay membrane switches 155, 157, 159, and 161, labeled "Load", "Unload", "Aux 1", and "Aux 2" respectively. The load delay is used to delay the starting of the load auger when the dryer fill switch 87 is activated to prevent the load auger from cycling too quickly. Note that the load delay is not used when the garner bin is being filled the first time after the Start or Auto switches are actuated. This allows the dryer to be filled without delay upon startup, while still preventing the load auger from cycling too quickly thereafter. The unload delay is used to delay the stopping of unload auger 43 after the metering rolls 39 stop to allow the unload auger to empty out the grain. The Aux 1 and Aux 2 delays are available for use with user-supplied auxiliary equipment. These delays may be set by the user in the same manner as the timers are set, as described above.

When the dryer is operating, the control circuit causes the first line of LCD display 119 to display the dryer mode of operation. The second line is caused to display the bushels per hour output of dryer 1 or the metering roll 39 rpm. The third line is caused to display the total bushels dried. By pressing switch 133, labeled "BPH-RPM-TOTAL BU", the user signals the control circuit to toggle the display on the second line between showing the metering rolls' rpm and the bushels or grain per hour that the metering rolls are then removing from dryer 1. With respect to the third line of the display, the total bushels figure the control circuit causes to be displayed is the total cumulative bushels dried since the bushel counter was last reset. This allows the user to measure the number of bushels in a load, from a field, etc. The total bushel counter may be reset by holding the reset switch 135 closed for a predetermined time such as five seconds. This action also may be used to reset a total number of batches counter (this counter is incremented by the control circuit by one each time the housing is unloaded when the dryer is operated in the staged batch mode) if the dryer is running in the Staged Batch mode, and also to reset the clock and date. In response to the signal from the reset switch, the control circuit displays instructions on LCD display 19 for directing the user through these operations.

Figure 9:
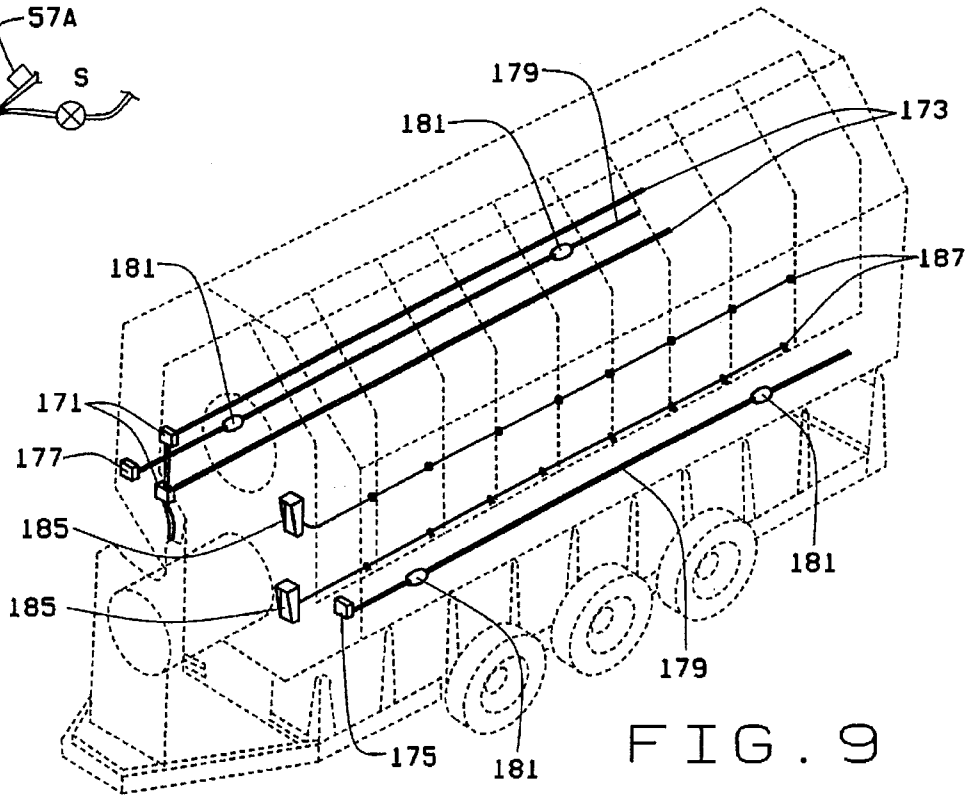
FIGS. 9 and 9A show the dryer in phantom and illustrate the location of various sensors with the dryer.
Figure 9A:
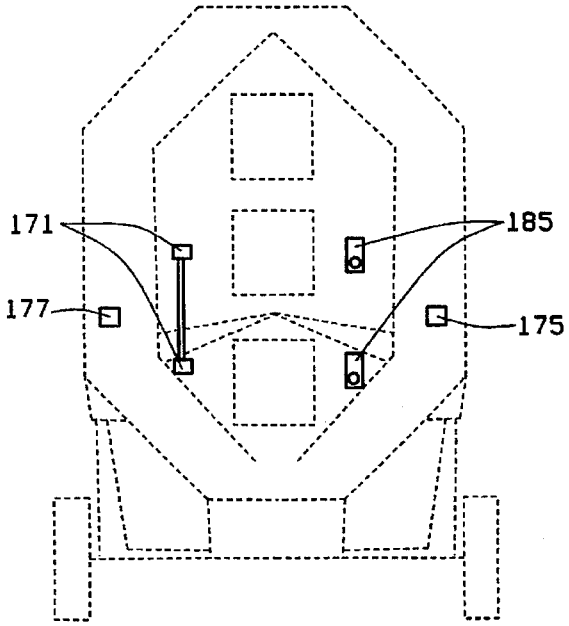

Turning to FIGS. 9 and 9A, the placement of various sensors used with the control circuit are shown. Specifically, each zone of the plenum has associated therewith a plenum high limit thermostat sensor 171 for each zone of the plenum. These thermostat sensors are operatively exposed to the temperature throughout the plenum by corresponding capillary tubes 173 which operate in conventional manner. When one of the plenum high limit sensors 171 reaches a predetermined limit, it sends a signal to the control circuit via suitable electrical connections (not shown) to shut down the dryer. Sensors 171 may preferably be model T675F1008 sensors from Honeywell.

Also shown in FIGS. 9 and 9A are a fixed limit grain temperature thermostat sensor 175 and an adjustable limit grain temperature thermostat sensor 177. The fixed grain limit sensor may preferably be a model 220985 sensor from Thermo-Disc, while the adjustable grain limit sensor may preferably be a model T675F1016 sensor from Honeywell. These sensors are connected to capillary tubes 179 which expose the sensors to the grain temperature substantially throughout the length of dryer 1. The fixed grain high limit sensor is disposed to respond to the temperature of the grain in the grain column GC on one side of the dryer, while the adjustable grain high limit sensor is disposed to respond to the temperature of the grain in the grain column GC on the other side of the dryer. Signals from sensors 175 and 177 are supplied through suitable electrical connections (not shown) to the control circuitry. When the temperature in the corresponding grain column exceeds the predetermined limits set by the fixed and adjustable grain limit thermostat sensors, the appropriate sensor sends a signal to the control circuit indicating a high grain temperature condition. The control circuitry in response shuts down the dryer, as described below.

Figure 9B:
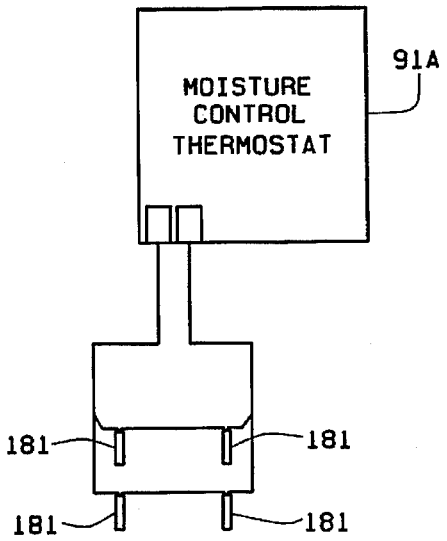
FIG. 9B illustrates the electrical connections between several of the sensors shown on FIG. 9.

The temperature of the grain is also sensed directly by a set of four temperature sensors 181, two of said sensors being disposed in each grain column. It is preferred that sensors 181 be model C7170A1002 sensors from Honeywell or the like. For convenience, temperature sensors 181 are disposed along the capillary tubes 179, although this is not required. Although the exact placement of the sensors 181 is not critical, by way of example, one sensor in each column may be placed about three feet from the front of the dryer 1, while the other sensor in that column may be placed about three feet from the back of the dryer. The electrical connection of these sensors is illustrated in FIG. 9B. The two sensors 181 in each grain column are connected in series, and the two sets of sensors are then connected in parallel to the inputs of moisture control thermostat 91A, discussed above in connection with FIG. 4. By connecting the four sensors in this manner, the resistance (and hence the signal) seen by the moisture control thermostat is comparable to that seen from a single sensor. The input to the moisture control thermostat as a result is an average temperature reading for all the grain in the horizontal plane through the dryer defined by the four sensors.

A burner controlling thermostat 185 for each burner is exposed by means of a capillary tube 187 to the temperature in the corresponding portion of the plenum. When the temperature sensed by one of these thermostats exceeds a predetermined value, the thermostat activates a solenoid SB (FIG. 14—sheet 5) to change the flow rate of gas to the corresponding burner to lower the burner temperature. Thermostats 185, therefore, operate independently of the control circuit to keep the burners operating within a desired temperature range.

Figure 14:
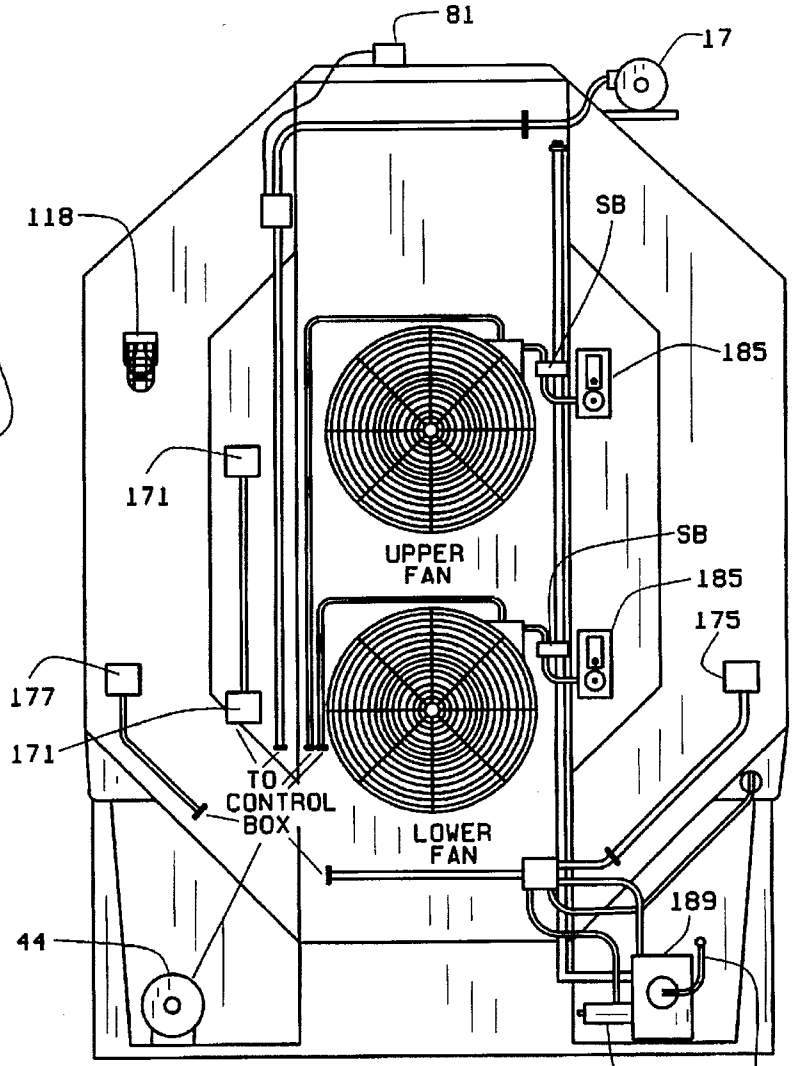
FIG. 14 is an elevational view of the front end of the dryer shown in FIG. 1 showing the location of a variety of sensors used to monitor operation of the dryer.

Also shown in FIG. 14 is an electronic safety shut-off valve 189 under control of the control circuit to shut off the gas flow to the dryer in the event of a dryer shutdown. Valve 189 also includes a manually operable actuator handle 191 as well. The electronic shut off valves manufactured by Maxon have been found to work well in this application.

Figure 15:
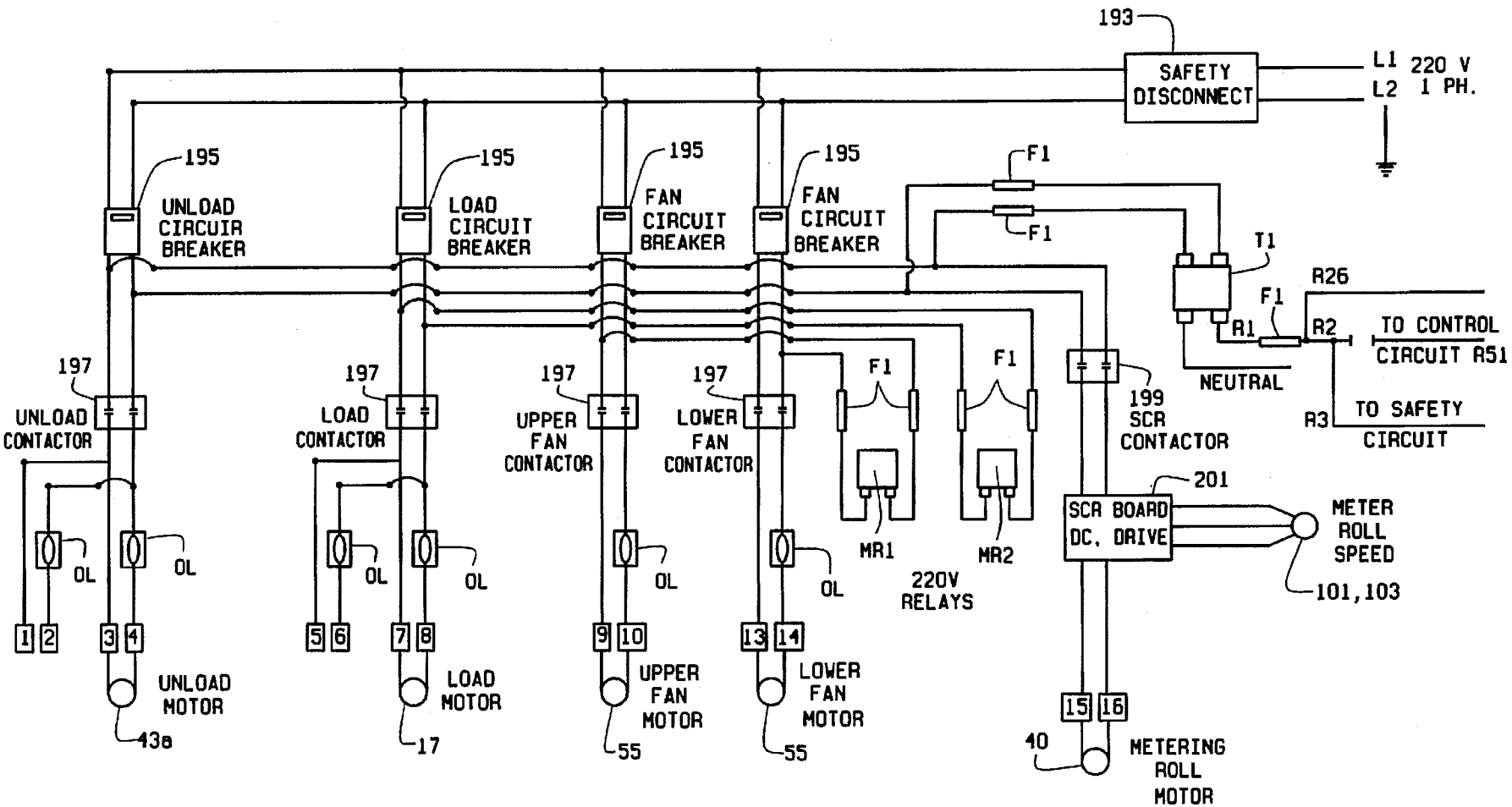
FIG. 15 is a schematic of the power wire circuit for the two fan dryer illustrated in FIG. 1 connected to 230 volt, single phase power.

Turning to FIG. 15 (sheet 6), the power circuitry for grain dryer 1 includes a safety disconnect 193 connected by suitable electric lines, such as the lines L1 and L2 shown, to the power source, shown as a 220 V, single phase source. Power from the safety disconnect is supplied to a set of four circuit breakers 195 connected through appropriate contactors 197 to the unload motor 43*a*, load motor 17, upper fan motor 55 and lower fan motor 55. Power from one of the circuit breakers 195 is also supplied through a set of contactors 199 and a conventional SCR DC drive circuit 201 to metering roll motor 40. It should be understood that the number of circuit breakers may vary according to the number of fans used in the dryer. The speed of the motor is controlled by potentiometers 101, 103 as described above. The connections to the potentiometers are made through a set of three lines P1, P2, and P3 as shown.

Power is also supplied to a step-down transformer T1. The stepped down voltage is supplied to the safety circuits and control circuit of the present invention, as shown.

Suitable fuses F1 and overload devices OL are disposed in the circuit as shown. In addition, a pair of relays MR1 and MR2 are connected across the various circuit breakers to shut off power if a fault occurs.

Figure 16:
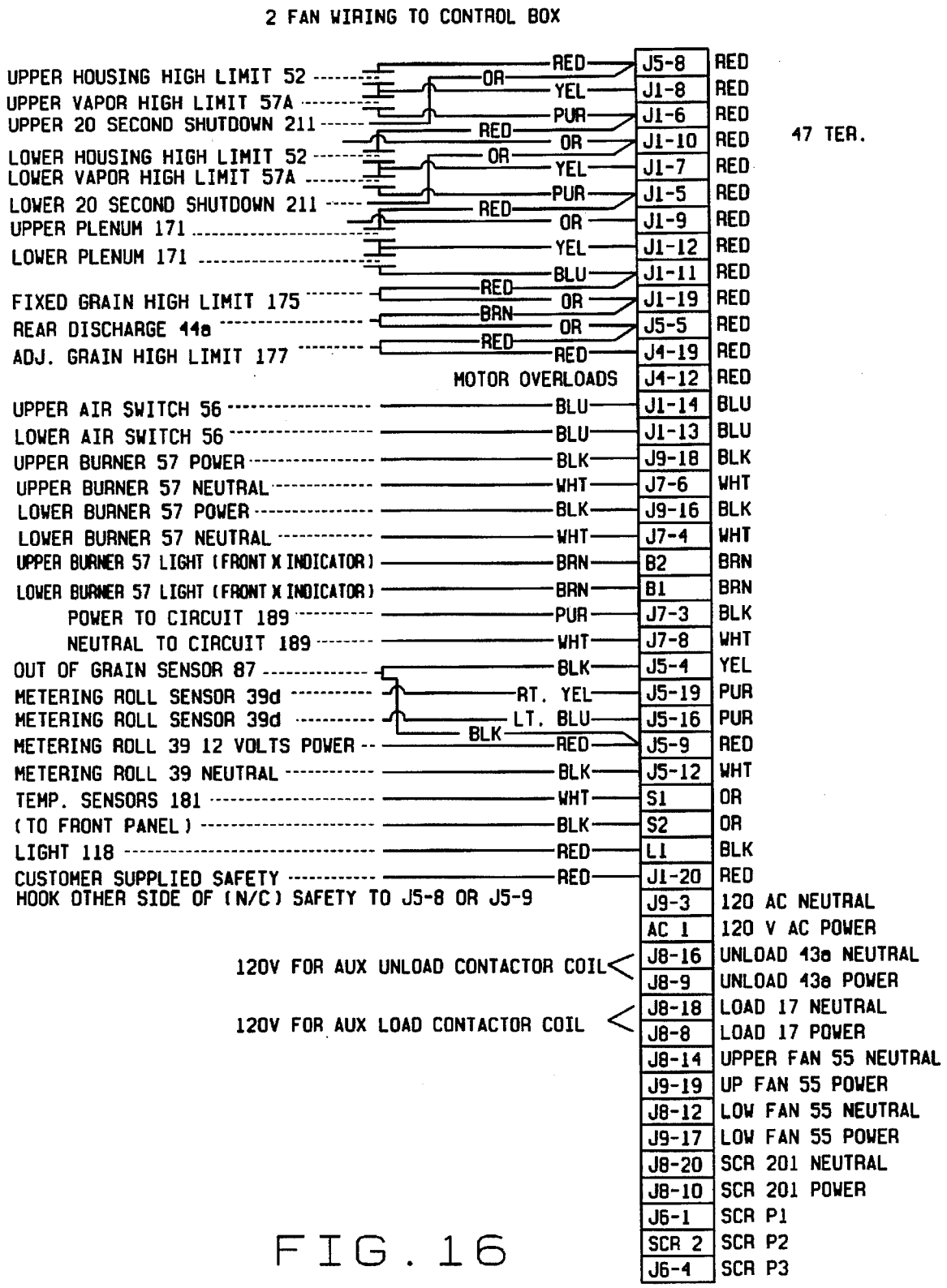
FIG. 16 shows the wiring connections between the power wire circuit shown in FIG. 15 and the computer controller located within the control panel shown in FIG. 4.

FIG. 16 shows the connections from the various sensors mentioned above to the control box 69, as well as power connections to various components. Although various sensors have been discussed above as connected to the control circuit, it should be appreciated that various other sensors such as the 20 second shutdowns and customer supplied safety shown in FIG. 16 may be used as well.

Figure 17:
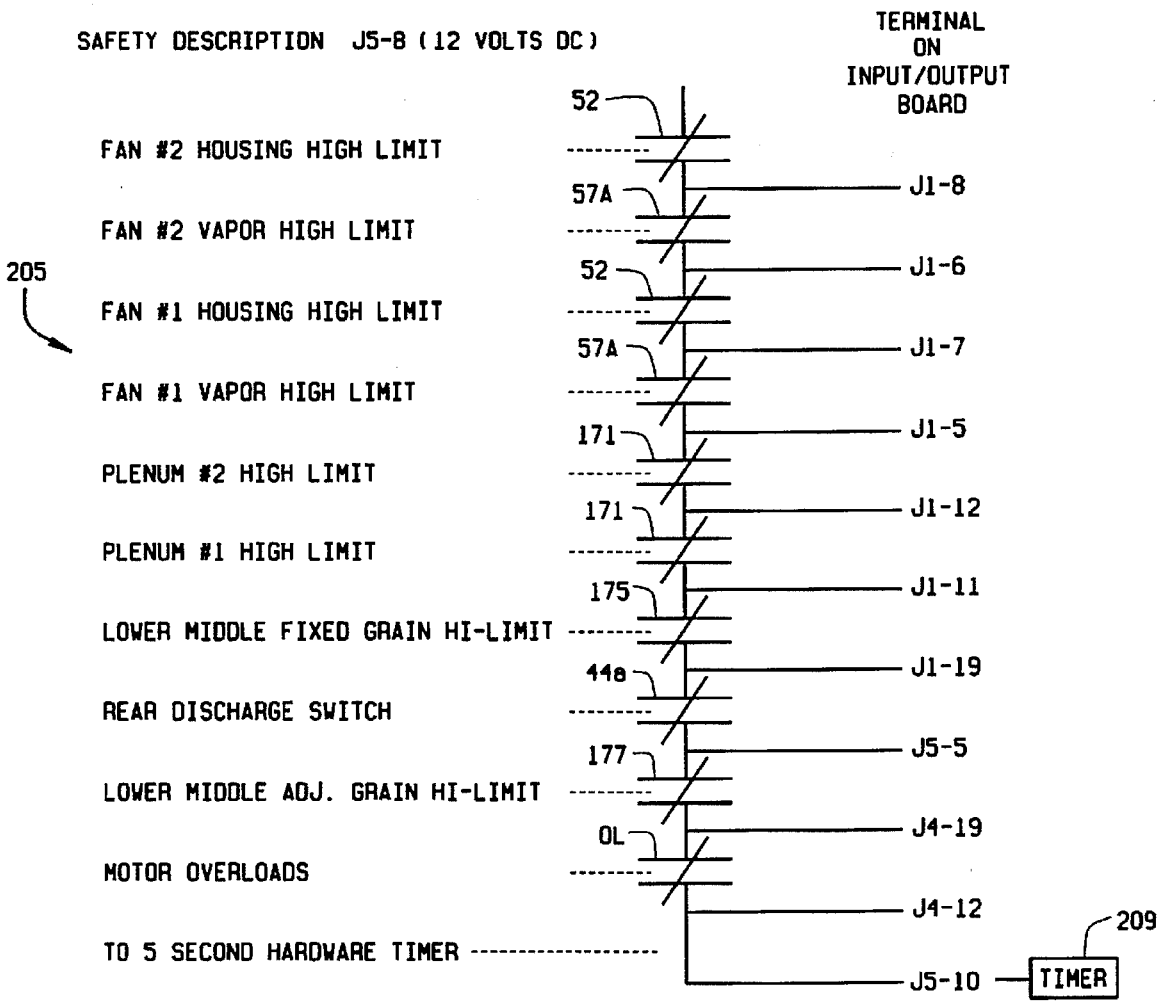
FIG. 17 is a schematic diagram of a primary safety circuit for the dryer of FIG. 1.
Figure 18:
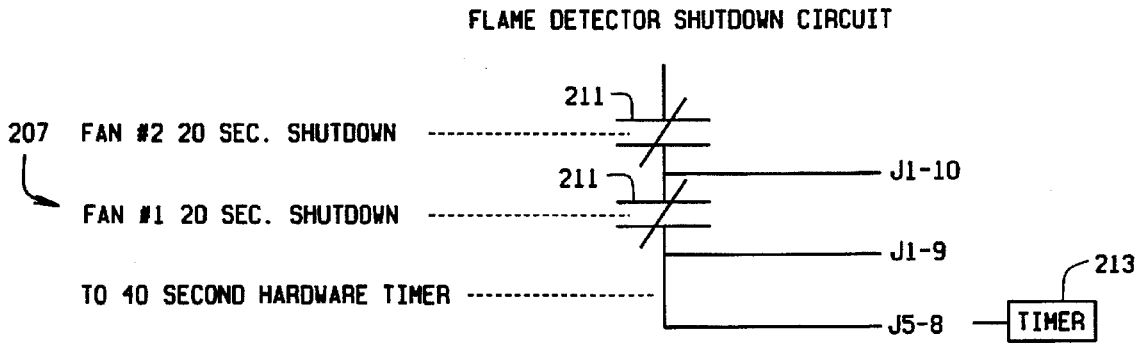
FIG. 18 is a schematic diagram of a flame detection safety circuit for the dryer of FIG. 1.

The safety circuits, labeled 205 and 207, of the present invention are shown in FIGS. 17 and 18. As shown, in safety circuit 205 the various sensors discussed above are connected in series with twelve volts supplied to one side of the circuit, and the other side being connected through a connection J5-10 to a 2.5 second hardware timer 209 (as well as the shift register inputs). In safety circuit 207, twenty second shutdown sensors 211 are connected in series with twelve volts supplied to one side of the circuit, the other side being connected through a connection J5-6 to a thirty second timer 213 (as well as the shift register inputs). In both cases, connection to the control panel is made between each adjacent set of switches, which enables the control circuit to determine not only that a fault has occurred, but also to identify the particular fault.

Figure 19:
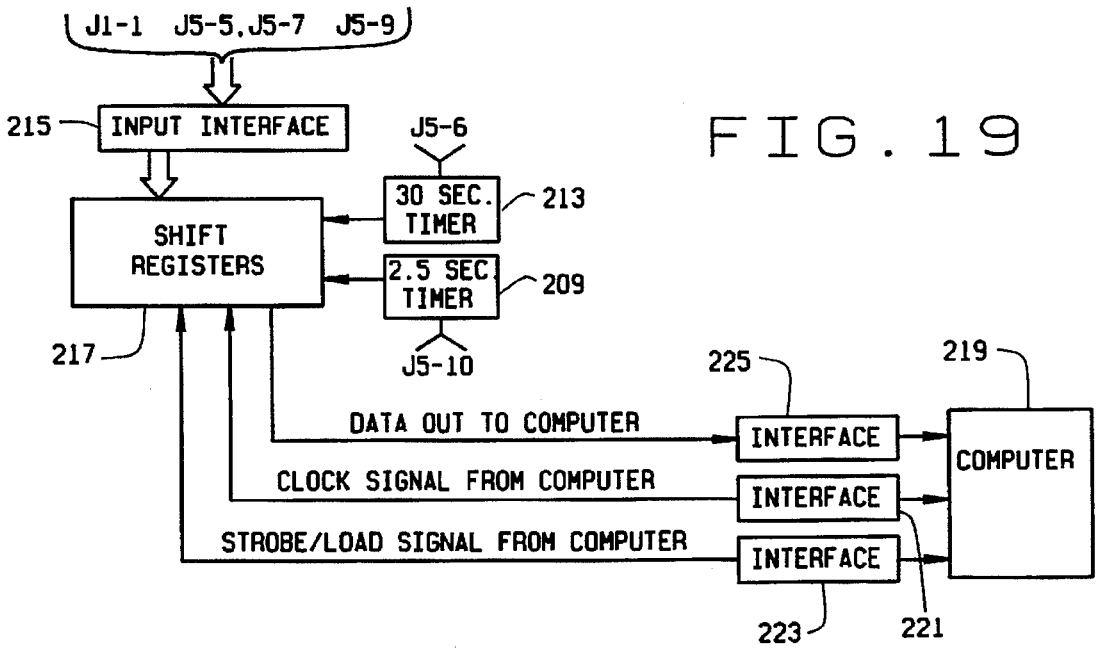
FIG. 19 is a block diagram illustrating the interface between the various sensor inputs used with the dryer of FIG. 1 and the computerized control circuit of the dryer.
Figure 19A:
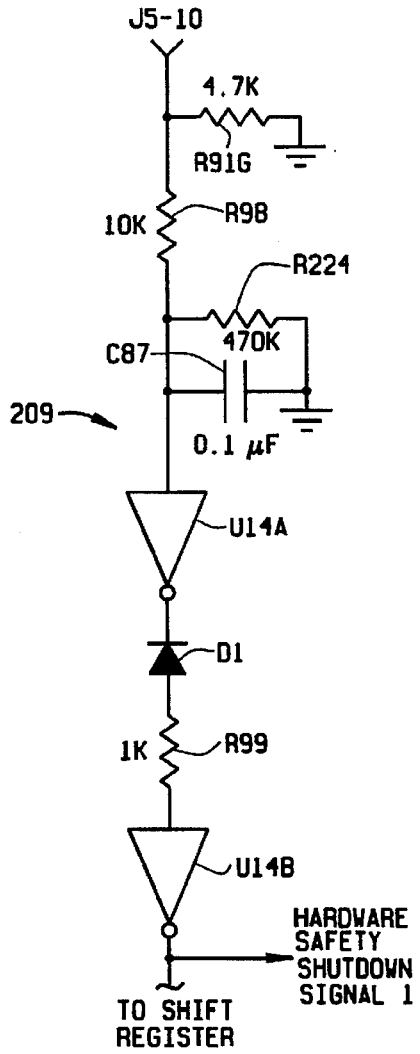
FIGS. 19A–19E are electrical schematics of the circuitry of FIG. 19.
Figure 19B:
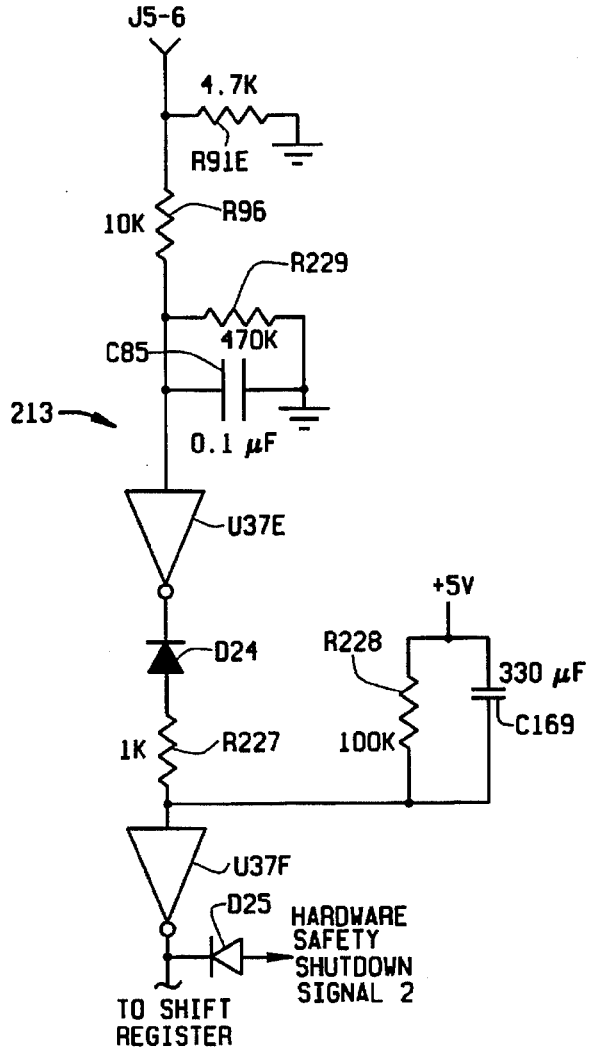

Turning to FIG. 19, most of the sensor outputs appear on pins labeled from J1-1 to J5-10. See FIG. 16 for the pin assignments for the more prominent sensor outputs. As shown in FIG. 19, those outputs on pins J1-1 to J5-5, and J5-7 to J5-9, are supplied through an input interface circuit 215 to a shift register circuit 217. In similar fashion, the output on pin J5-6 (potentially signaling a flame detector shutdown fault—see FIG. 18) is supplied through forty second hardware timer 213 to the shift register circuitry, and the output of pin J5-10 (potentially signally a safety circuit fault—see FIG. 17) is supplied through five second timer 209 to the shift register circuitry 217. It should be understood that the particular time constants of the hardware timers are arbitrary and can be varied within reason as desired. The hardware timers are shown in detail in FIGS. 19A and 19B. As shown therein, each timer includes a 4.7K resistor (R91G, R91E) connected between the input and ground. A 10K resistor (R96, R98) is connected in series between the input and an inverter (U14A, U37E). Connected between the input of each inverter and ground is a parallel circuit consisting of a 470K resistor (R224, R229) and a 0.1 μ-F capacitor (C87, C85). The output of each inverter is supplied through a diode (D1, D24) and a 1K resistor (R99, R227) in series to the input of a second inverter (U14B, U37F). The forty second timer also has a parallel circuit consisting of a 100K resistor R228 and a 330 μ-F capacitor C169 between the input of the second inverter and a five-volt source. The output of the second inverter in each case is supplied to the shift register circuitry 217. In the case of the five second timer, that output also is supplied to the circuitry (described below) as a hardware safety shutdown signal-1, which will shut down the dryer operation even if the software safety measures, described below, fail. Similarly, in the case of the forty-second timer the output of the second inverter is supplied through a diode D25 to provide a second safety shutdown signal, labeled signal-2.

The shift register circuitry 217 receives a clock signal and a strobe signal from a computer 219, which forms the core of the control circuitry of the present invention. More specifically, computer 219 supplies the dock and strobe signals to the shift registers through suitable interface circuits 221, 223. In response, the shift registers, as described below send serial data back through a suitable interface 225 to computer 219. Shift register circuitry 217 preferably includes a number of cascaded shift registers. For example, eleven cascaded 4021-type parallel in/serial out shift registers have been found to be satisfactory for this purpose.

Computer 219 operates under programmed control, and is preferably a microcontroller of the MCS-51 family of Intel microcontrollers, such as a TP83C51FA microcontroller. Any programming language may be used to program the controller. Of course the control system of the present invention could be implemented instead using other types of microcontrollers, microprocessors, or even more traditional computer systems such as personal computers or minicomputers as the process controller.

The software which control computer 219 and the electronic circuitry described herein control all aspects of the operation of grain dryer 1, including grain handling, safety input monitoring, heater control, operational statistics tracking, error logging, and failure diagnostics. These key features operate as described below. The software executes in real time in the sense that the control circuit is able to detect and respond to events in a short enough period of time that the system can adequately control the process being monitored. As will become apparent, computer 219 relies on interrupts from external sources and an internal clock to schedule and control dryer operations. Tasks managed by the software fall into two general categories—foreground tasks and background tasks.

The foreground tasks are those easily visualized activities such as turning motors off and on, reading control switch inputs, updating the LCD display, etc. These activities occur frequently, in many cases several times each second, but do not have to happen at any precise time. The background tasks in contrast are the somewhat invisible activities of the system. These tasks include counting pulses from the metering roll sensors 39*d* whenever they arrive; generating signals to keep hardware watchdog timers from shutting down the system; running the software timers that control sequencing of motors, error detection, etc.; and scheduling "slower" activities like calculating RPM or updating the LCD screen that need only occur once each second. In the dryer 1 control system some of these background activities occur as frequently as once every 120 microseconds.

Figure 20:
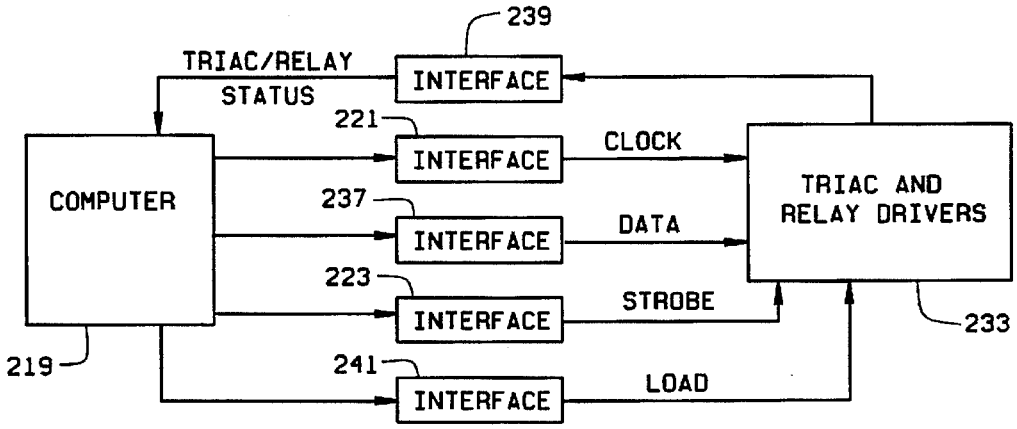
FIG. 20 is a block diagram illustrating control over the various components of the dryer of the present invention by the use of triacs and relays.
Figure 20A:
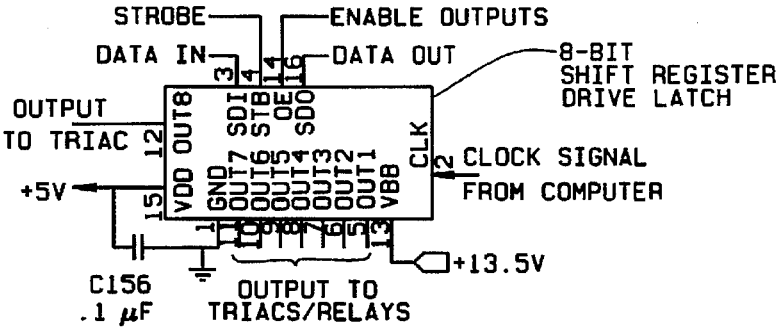
FIGS. 20A–20F are electrical schematics of the circuitry of FIG. 20.

The electronic controls used in the present system are particularly suited for grain dryer 1. All input signals except the metering roll pulse inputs from sensors 39*d* are essentially the same whether the input source is a control switch or a set of contacts on a safety sensor. There are two types of output circuits—triac outlets and relay outputs. See the discussion below with respect to FIGS. 20–20F for a discussion of the output circuits.

Figure 19C:
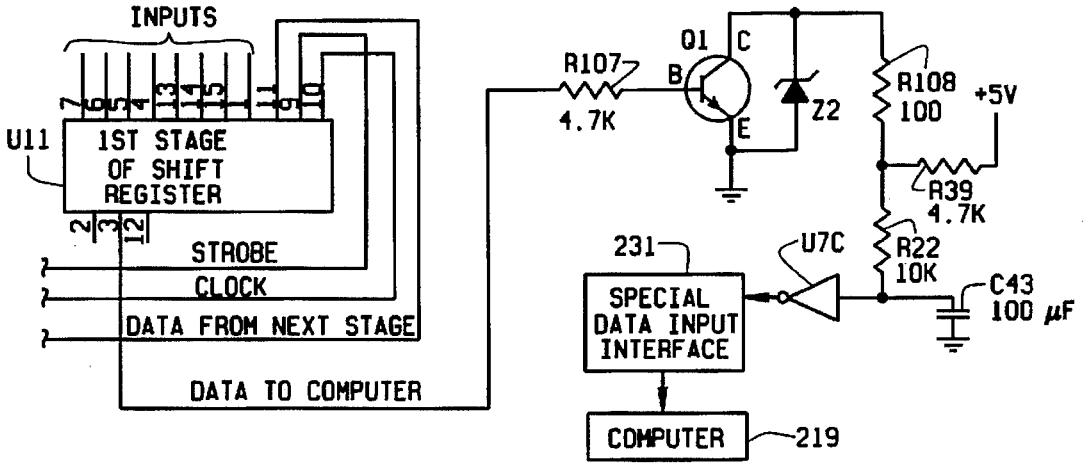
Figure 19D:
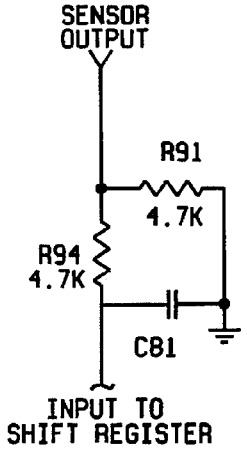

Turning to FIGS. 19C–19D, the first stage, labeled U11, of cascaded shift register circuit 217 is shown. It has eight inputs, an output line for supplied data to computer 219, a strobe input, a clock input, and an input for receiving data from the next stage. Each sensor output (see FIG. 19D) is supplied through a filter consisting of a 4.7K resistor R91, a 47K resistor R94, and a 0.1 μ-F capacitor C81 connected as shown to a corresponding pin of its associated shift register. The input interface circuitry 215, therefore, consists of such resistor/capacitor circuits for each sensor output. Each input to a shift register is fed to the corresponding one of eight input lines of its associated parallel to serial shift register, such as register U11. The 4.7K resistor R91 is connected between the input terminal and ground, so that it also serves as a "pull down" to keep the shift register input near zero volts unless the 12 volt safety signal has kept it high. This is another safety feature of the overall dryer design. If anything goes wrong, even a safety circuit wire breaking, the dryer controls will detect an error condition and shut down the system.

Figure 21A:
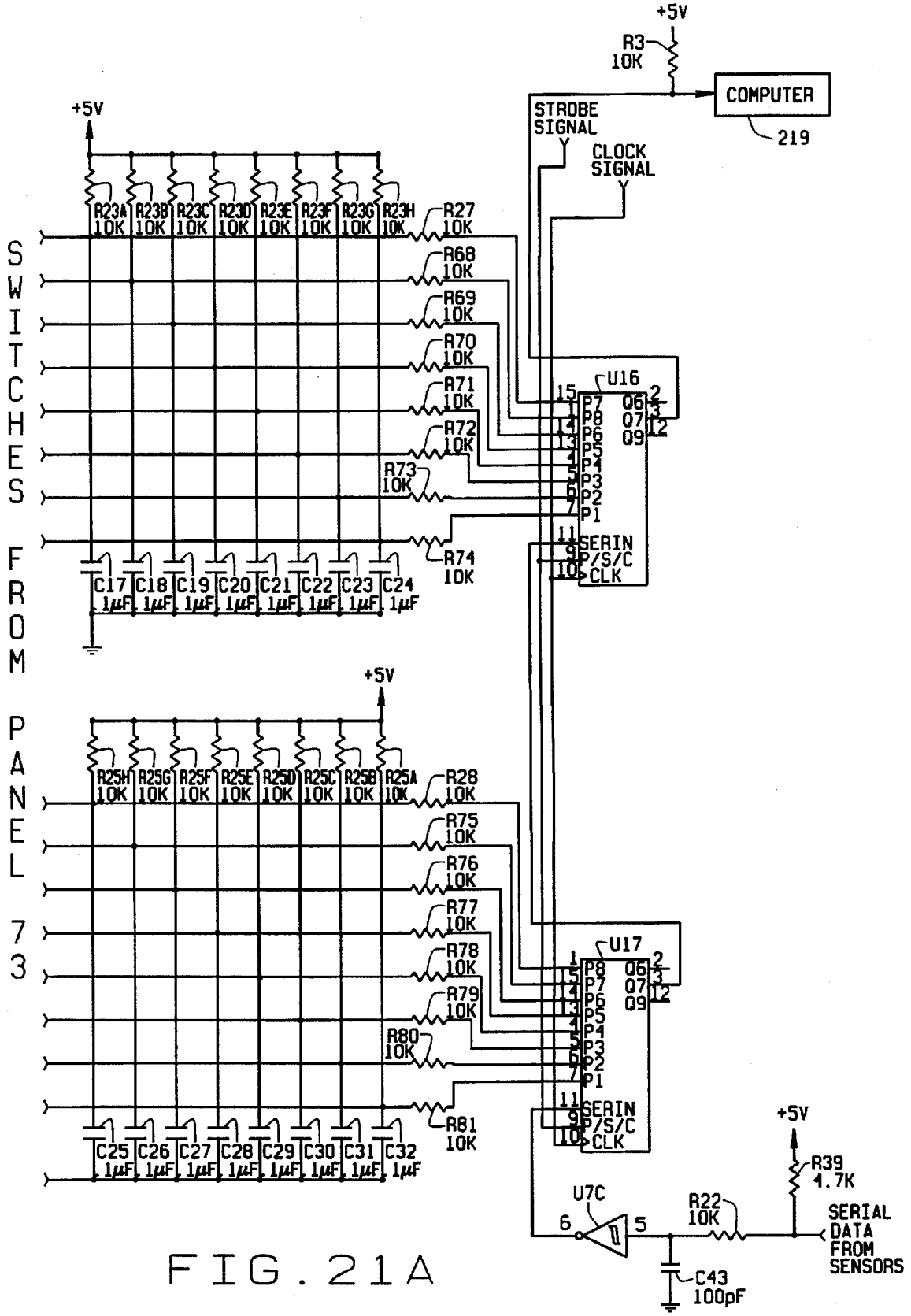

When a fresh set of input readings is required by the system the microcontroller 219 sends out a strobe pulse that latches the current state, high or low, of each input pin into the shift register. This puts a "snapshot" of all inputs into the registers. Once the current states have been latched into the shift registers the microcontroller shifts this data into its internal memory one bit at a time by clocking the registers. A total of 112 bits of data are read and stored when this occurs. This data is shifted into the microcontroller a total of three times. These three sets of data are compared to one another and must be identical before the computer takes action. If all three readings are not the same, a fresh reading of the inputs is strobed into the latches before the program continues. This prevents the computer from using any bogus data that may have been garbled by electrical noise. The data is supplied from the shift registers in serial form, so that all the data passes through first stage register U11. That chip supplies the data one bit at a time through interface circuitry 225. That circuitry includes a 4.7K resistor R107 connected to the base of a transistor Q1. The collector of the transistor supplies the data through a resistor capacitor network consisting of a 100-ohm resistor R108, a 4.7K resistor R39, a 10K resistor R22 and a 100 pF capacitor C43, to the input of an inverter U7C. The output of inverter U7C is supplied to a serial data input interface 231, which in turn supplies the data to computer 219. Serial data input interface 231 is described in detail below in connection with FIG. 21A.

Figure 19E:
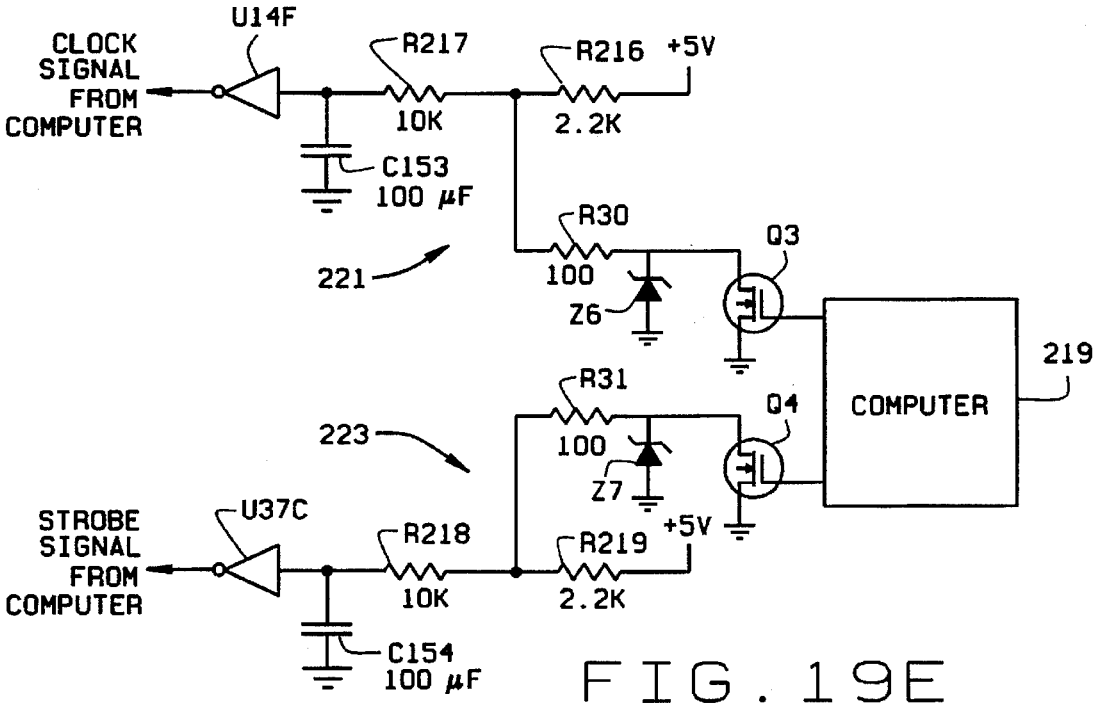

The interface circuitry 221, 223 which computer 219 uses to supply the strobe signals and clock signals to the shift registers (and to the rest of the control circuitry) is shown in FIG. 19E. The circuits for each are essentially identical. The signal from the computer is provided to a transistor (Q3, Q4) whose output is fed through a resistor/capacitor network consisting of a 100 ohm resistor (R30, R31), a 2.2K resistor (R216, R219), a 10K resistor (R217, R218), and a 100 pF capacitor (C153, C154) to the input of an inverter (U14F, U37C). The output of inverter U14F is the clock signal, and the output of inverter U37C is the strobe signal.

Outputs work in a similar fashion to the digital inputs. See FIGS. 20–20F. Computer 219 has stored in internal memory a pattern of bits that corresponds to the on/off conditions of the system triacs and relays which are used to turn off and on the various motors and other devices discussed above. This information is supplied to a set of triac and relay drivers 233 two times. The triac/relay drivers comprise a set of cascaded serial to parallel output registers, such as the drive latch U18 shown (FIG. 20A). It has been found that a cascaded set of three UCN5895-type serial to parallel output registers work satisfactorily in the present invention. The first data that is sent out is simultaneously shifted back into the microcontroller. If it receives back what it sent out, a signal is sent to the output registers that latches the data to the outputs of the integrated circuits which turn on triacs and relays.

More specifically, computer 219 sends data in serial fashion to shift register U18 (and through that register to the other registers making up triac and relay driver circuitry 233) through an interface circuit 237. Interface circuit 237, as shown in more detail in FIG. 20E, includes a transistor Q5 which is connected to the computer to receive data. A 10K pull-up resistor R3 is also connected to that particular pin of the computer. The output of the transistor is supplied through a resistor/capacitor network consisting of a 100 ohm resistor R32, a 2.2K resistor R220, a 10K resistor R221, and a 100 pF capacitor C155 to the input of an inverter U37D. The output of inverter U37D is connected to the "Data In" pin of the shift register U18. As mentioned above, this data is also simultaneously shifted back to microcontroller 219. This is accomplished using interface circuit 239, shown in more detail in FIG. 20F. Interface circuitry 239 takes the serial data from the data out pin of chip U18 and supplies it through a 4.7K resistor R209 to the base of a transistor Q20. The collector of transistor Q20 is connected through a resistor/capacitor network consisting of a 100 ohm resistor R208, a 4.7K resistor R41, a 10K resistor R40, and a 100 pF capacitor C44, to the input of an inverter U7E. The output of inverter U7E is supplied to computer 219. A 10K pull-up resistor R3 is also connected to that pin of computer 219.

The clock and strobe signals are supplied to chip U18 from the computer using the interface circuitry 221 and 223 described above in connection with FIG. 19E.

If the data received back from the drive latch/shift registers is the same as what was sent out, computer 219 uses interface circuit 241 (shown in detail in FIG. 20D) to signal the shift registers to load or latch the data to the outputs of the drive latches (such as chip U18). The load signal is supplied by the computer through a 100K resistor R18 and a diode D6 to the input of an inverter U6C. The input of the inverter is also connected to the diode/capacitor junction of a series circuit consisting of a 22K resistor R10, a diode D4, and a 22 μF capacitor C7. The output of inverter U6C is provided to a transistor Q1, whose output is supplied through a resistor/capacitor network consisting of a 100 ohm resistor R19, a 2.2K resistor R211, a 10K resistor R212, and a 100 pF capacitor C150 to the input of a second inverter U14E. The output of the second inverter is supplied through a diode D16 to a third inverter **U14*d*, whose output is directly connected to the enable pin OE-bar of each drive latch. A 47K resistor R213 and both hardware safety shutdown signals are also connected to the input of third inverter U14D**. As a result, the hardware safety shutdown signals can shut down the dryer (by shutting down the triacs and relays) even if the computer software safeties should completely fail.

The two basic types of output control devices of the present grain dryer control system are triacs and relays. A triac, as is known, is a solid state device that switches 120 VAC on or off based on the state of the signal on its input. The relays used in the system have both normally open and normally closed contacts. When activated by its control signal the relay "pulls in", closing the normally open contacts and opening the normally closed contacts.

Figure 20B:
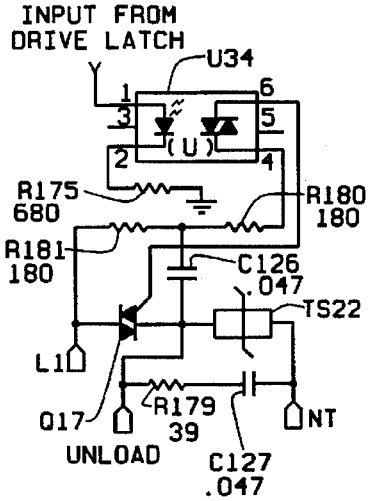
Figure 20C:
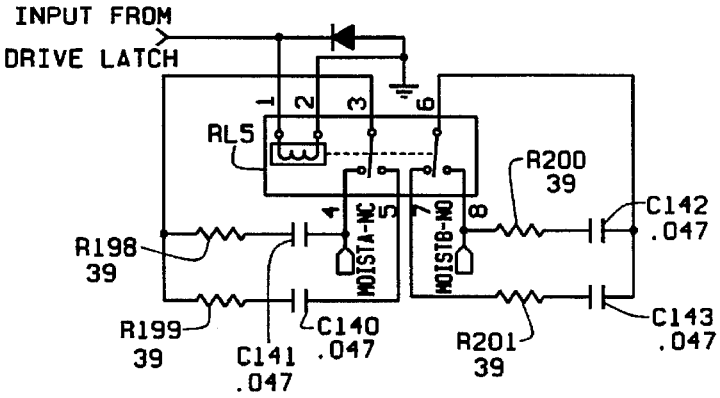
Figure 20D:
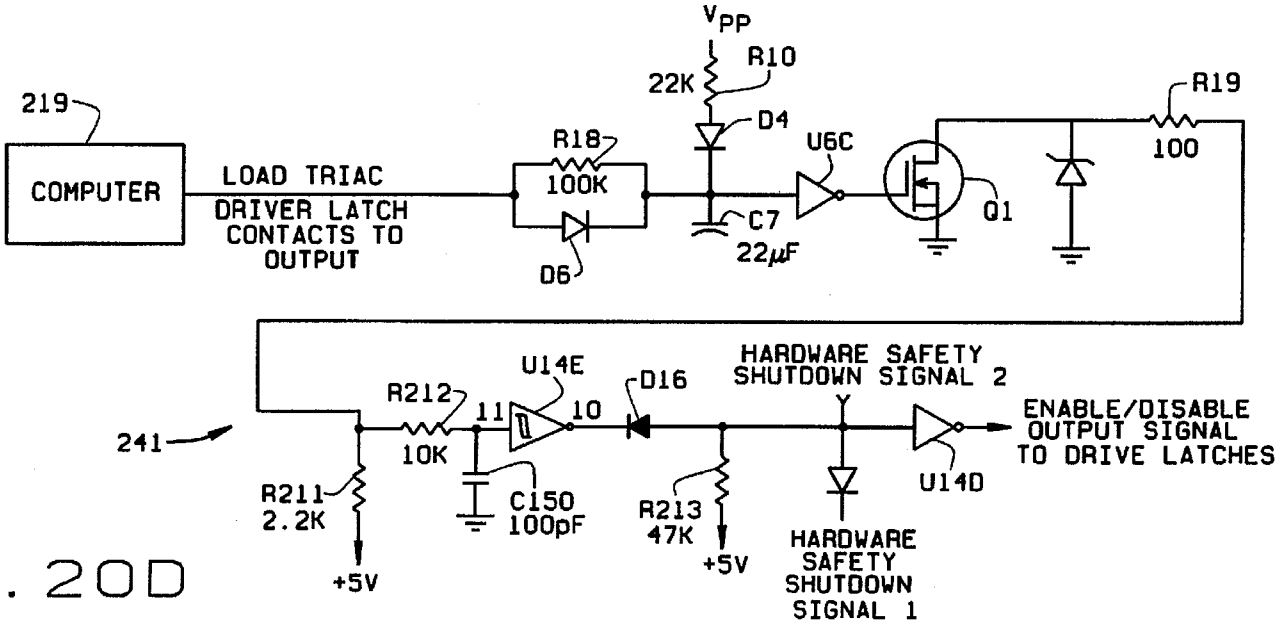
Figure 20E:
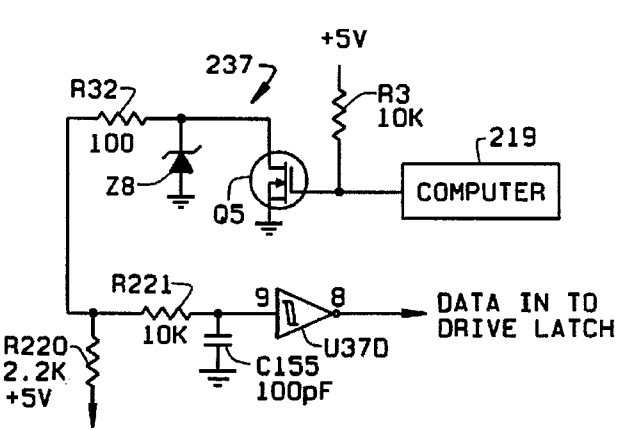
Figure 20F:
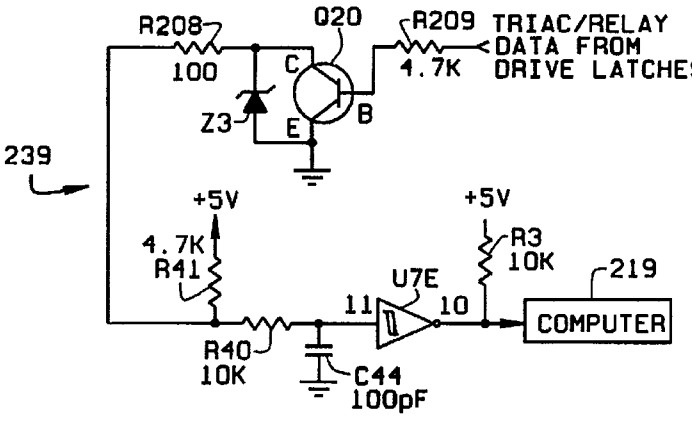

A triac control is shown in FIG. 20B, while a relay control is shown in FIG. 20C. It should be understood that all triac controls are identical, as are all relay controls. The triac control includes an optocoupler U34 (such as an MOC3022-type optocoupler) having its input connected to the corresponding output drive the associated drive latch (such as chip U18). When the proper input signal is present, this turns on a triac Q17 having its gate connected to the output of the optocoupler. When triac Q17 is on it allows power from line L1 and neutral NT to flow through the associated load. In the case of FIG. 20B, the illustrative load is the motor **43*a*** for the unload auger. It should be understood that each motor has its own triac or relay.

Operation of the relay controls (see FIG. 20C) is similar. The corresponding output from the associated drive latch directly energizes a relay such as relay RL5, which in conventional manner opens the normally closed set of contacts and closes the normally open set of contacts.

Turning to FIG. 21, computer or microcontroller 219 is connected in conventional manner to various devices such as a pair of 74HC573-type latches U2 and U4, a 28F512 memory chip U3, a sound driver 251, the circuitry of FIGS. 19 and 20 (described above), serial data input interface 231, and, through a pair of identical interface circuits 253, to the first and second metering roll sensors **39*d*. Computer 219 also includes means for resetting the circuit, indicated generally by the line labeled "Reset." More significantly, computer 219 is connected to a memory labeled TIC which includes its own built in battery. Memory TIC is preferably a model DS1494LF5 device from Dallas Semiconductor. The computer stores fault condition and diagnostic information in the TIC memory so that a record of dryer shutdowns may be kept and referred to even if power is lost to dryer 1**.

As mentioned above, the serial data from the various sensors used in the present system is supplied to serial data input interface 231. This interface is shown in more detail in FIG. 21A. The serial data from the sensors is supplied through a resistor/capacitor network consisting of a 4.7K resistor R39, a 10K resistor R22, and a 100 pF capacitor C43 to the input of an inverter U7C. The output of inverter U7C is supplied to the serial input pin of a 4021-type shift register U17. Shift register U17 may be cascaded with as many additional shift registers as are needed to accommodate the desired inputs. A second shift register U16 is shown, but it should be understood that more or fewer are also contemplated. The input pins of the shift registers are connected to the switches described above in connection with panel 73. Computer 219 uses the strobe and clock signals described above to serially input this information, including the data from the sensors. A 10K pull-up resistor R3 is connected to the output of the last shift register.

The one other input source to the computer are the metering roll pulse inputs from sensors **39*d*. The pulses generated by the metering roll sensors are routed to two external interrupt pins on the microcontroller via identical signal conditioning interface circuits 253 that square up the pulses and convert them to voltage levels suitable for the microcontroller 219. That circuitry is shown in detail in FIG. 21B. It includes a filter section consisting of a 10K resistor R57, a resistor R11, a 10K resistor R51, a 100K resistor R54**, and a 100 pF capacitor C48. A pair of diodes D20 and D23 are also provided for squaring up the pulses. The signal from these components is supplied to a comparator U13D having a 330K resistor R48 in its positive feedback loop. The output of the comparator is provided through a 27K resistor R45 to the input of an inverter U7D, whose output is supplied to computer 219. A 10K pull-up resistor R82 is connected to the same pin of computer 219 as the output of inverter U7D.

The system software is such that any time a negative pulse arrives at a meter roll input, the program is interrupted briefly and a count of the pulses for that input is incremented. Afterwards the program returns to whatever it was doing when the interrupt occurred. This operation is typically completed in a few microseconds time.

Grain Handling—Overview

The control system of the present invention uses the various switches, sensors, and other input devices described above to sense whether or not the dryer is low on grain, whether the grain is above or below the desired temperature and which of several modes will be used to operate the load auger, unload auger, and metering rolls. System outputs are used to select various temperature probes and operate electrical contractors that start and stop the augers and metering rolls.

For example, with respect to the load auger, computer 219 monitors the paddle switch 87 in the top of the dryer 1 to determine if the dryer is low on grain. If the dryer needs grain the load auger 15 is started by activating the corresponding triac. The system continues to monitor the status of the grain and shuts off the load auger once the dryer is full. When the paddle switch 85, 87 signals a need for grain a "load delay" timer is started. This timer is implemented in software and is loaded with a user programmed value. The system ignores the state of the paddle switch 87 and will not allow load auger 15 to be restarted until the load delay timer has expired. This prevents the motor 17 from being constantly started and stopped and reduces wear on the motor, bushings, belts, bearings, and related components that are a part of the load auger system. Once the timer has expired, the system resumes monitoring the status of the grain and will run the load auger as required until the next time the auger is shut off. Note, however, that such a delay would be inappropriate upon initial startup of the dryer since the dryer at that point is presumably empty and no reason for delay exists. The load delay timer is, therefore, only used after the dryer is initially filled with grain.

The second load auger related feature is the "Out of Grain" timer. This timer, programmable by the user, is used by the system to detect that there is no more grain available for drying. When the out of grain timer is enabled by the user, software tracks the length of time the load auger 15 has been running. The timer starts running when the load auger is turned on and is stopped when either the load auger is shut off or the metering rolls 39 are discharging grain. If the timer expires, the dryer is shut down and the time and date of the shutdown are saved in the dryer's integral error history memory (See the error logging section for details.)

Grain Handling Moisture Control

The dryer's moisture control system is used to automatically dry the grain to the percentage moisture content desired by the user. This is accomplished by the system continuously monitoring the temperature of the grain being dried using sensors 181 and controlling the rate at which the grain is discharged from the dryer by the metering rolls 39. In accomplishing this control the system takes into account which heaters the user has selected for operation and the size and type of the dryer being controlled.

If the dryer is operating in "Continuous Flow" and the user has selected "One Speed Unload" with "Moisture Control" turned on then the dryer will discharge grain at the high rate when the grain temperature is at or above the temperature setting of the moisture control thermostat. No grain will be discharged when the grain is below the desired temperature.

If the dryer is operating in "Continuous Flow" and the user has selected "Two Speed Unload" with "Moisture Control" turned on then the dryer will discharge grain at the high rate when the grain temperature is at or above the temperature setting and will discharge grain at the low rate when the measured grain temperature is below the thermostat setting.

When the dryer is operated in the "Staged Batch" mode the moisture control behave differently than in "Continuous Flow." At the end of the "Dry" cycle, if the grain temperature grain reaches the desired temperature. This is indicated by a "Temperature Hold" message on the display screen.

Current dryer models incorporate either 1 or 2 temperature probes depending on the size of the dryer. Single stack dryers have only on probe; multiple stack dryers have two. The probe to be used for the grain temperature measurement is selected by the system based on how many heaters the dryer has and which ones will be running during the drying cycle. This is because the most accurate moisture control will occur when the temperature of the grain is measured in the last stage of the dryer where heat is applied. The system is engineered so accurate moisture control will occur even when the user has setup the fans and heaters to cool the grain in the lower dryer stages.

If the dryer is a single stack dryer the lower temperature sensor is selected since it is the only one that exists.

In a double stack dryer with two heaters the lower temperature sensor will be selected if the Burner #1 control switch is selected for "On" or "Automatic" operation; otherwise the upper sensor is selected. In all dryers the burner closest to the bottom is designated as #1 and there can be a number of burners in the dryer, each having a control switch for continuous, automatic, or off operation.

In a double stack dryer with more than two heaters the system will select the lower temperature sensor if Burner #2 is selected for on or automatic operation; otherwise the upper sensor will be selected.

In a triple stack dryer equipped with three heaters, the system will select the lower sensor if Burner #1 is on or auto; otherwise the upper sensor will be selected. A triple stack dryer with more than three heater will select the lower sensor if Burner #2 will run in on or auto and will otherwise select the upper sensor.

Grain Handling Metering Rolls and Unload Auger

The metering rolls and unload auger work in conjunction with the moisture control system to regulate the flow of grain through the dryer. The metering roll system governs the rate at which grain moves through the dryer and the unload auger carries the metered grain away and delivers it to the user's storage system.

In operation, the system will start and run the unload auger anytime the metering rolls are turning. When the metering rolls stop, the unload auger will continue run for the length of time the user has programmed into the "Unload Delay" except in certain cases. For example, if the computer detects any problem other than an out of grain condition, it causes the unload auger 43 to stop immediately.

The rotation rate of the metering rolls is set by the user with the two front panel mounted potentiometers 101, 103. One pot sets the high speed rate and the other sets the low speed rate. The system selects the appropriate speed pot as described in the moisture control section.

The metering roll system provides information to the portions of the system that calculate the amount of grain processed by the dryer and generates data that the safety system uses to determine whether or not the dryer is operating properly. This data is generated by sensors 39*d* attached to the ends of the two metering roll shafts. As each meter roll 39 turns, the slotted wheel interrupts a beam of infrared light sixty times per revolution. This causes a pulse train whose frequency is directly related to the rotational speed of the metering roll to be sent to the system computer 219. The pulse rate for each metering roll is individually tracked by the computer and used for calculating the Meter Roll RPM, Total Bushels Processed, and detecting problems or errors in the meter roll drive system. See discussion below.

Heater and Fan Control—Overview

Heaters and fans are controlled by the system based on the settings of the control switches and the operational state of the dryer. There are specific sequences of events that occur to start a given heater and fan. This sequencing provides safe operation of the dryer and deeps peak electrical supply current to a minimum as the fans and heaters start and stop.

Heater and Fan Control—Fan Operation

Each fan in the dryer has its own control switch that the user uses to select between off, on, or automatic operation. In the off position the fan will never operate. In the on position the fan will be started and will run continuously anytime the dryer start switch has been pressed and the dryer is operating in Continuous Flow or Staged Batch operation.

In Staged Batch Operation, when set to the automatic position, the fans will be started and stopped under computer control. The fans start and run during the dry and cool cycles and are shut off during the unload cycle. In Continuous Flow Operation the fans will run with the control switch in any position except off.

There is a "Fan Delay Timer" that comes into play when the system starts fans in a multiple-fan dryer. Beginning at the top of the dryer, where it is preferred that the largest fans are located, the fan delay timer is started at the same time the fan contactor is energized. This length of time, set to a default value of five seconds, is programmable. Until the fan delay timer expires, computer 219 will not attempt to start another fan.

Heater and Fan Control—Heater Operation

Each heater in the dryer has its own control switch that the user uses to select between off, on, or automatic operation. In the off position the heater will never operate. In the on position the heater will run continuously as long as there is an indication of airflow through the heater and the dryer has been started and is running continuous Flow or Staged Batch operation.

In Staged Batch Operation, the heater will start and stop under computer control anytime the Dry cycle is in effect or the moisture control system has extended the Dry Cycle because of low grain temperature. In Continuous Flow operation, the heaters will start and run if there is airflow and the control switch is in any position other than off.

The following sequence of tests and conditions must be satisfied before the system will attempt to run a heater. First there must be adequate airflow through the fan housing. Airflow is sensed by diaphragm type switch 56 which is activated when air pressure in the plenum closes the switch contacts. Of course air velocity in the housing could be sensed instead.

Once the system detects that the fan 53 has been started and adequate airflow is being produced a ten second purge timer is started. If airflow is lost during the purge the timer sequence starts over until a continuous purge often seconds has been accomplished. This purge evacuates any unspent fuel from the heater housing.

At the end of the purge cycle the heater's ignition system is energized and the solenoid operated fuel valves S are opened. Flame detection circuit 211 in the heater control senses the presence or absence of flame and makes this information available to the system. Any time the heater is energized but a loss of flame is detected, a "20 Second Burner Timer" is started by the system. This provides a means for the safety system (described elsewhere) to ignore brief, acceptable flameouts and false loss of flame indications. For example, the flame detection circuit/sensor 211 may sometimes indicate a loss of flame due to the naturally occurring turbulence in the heater housing 51. In addition, the burners can be set to cycle on and of deliberately for specialty crops such as popcorn. This delay prevents such cycling from shutting down the dryer. The twenty-second timer filters and smoothes the sensor output to prevent these false indications. This timer is described more completely in the safety section.

Safety Systems and Error Logging—Overview

The dryer's safety and error logging system help ensure that both the operator and the dryer itself are protected from problems that may occur while the dryer is operating. The safety system is implemented in two layers. The first layer, implemented in software, continuously scans the dryer's safety inputs for conditions that are outside those encountered in normal operation. Examples of these conditions that are outside those encountered in normal operation. Examples of these conditions are fan motor overloads, grain jams at the discharge outlet, high grain temperatures, or abnormally high temperatures in the fuel supply, fan housing, or plenum. The software can also detect two types of failures in the metering roll drive system.

The second layer of the safety system is implemented in hardware. This layer serves as a backup to the computer system and operated totally independently to ensure that even if the computer did not detect a problem for some reason, the dryer would still be shut down.

Safety Systems and Error Logging—Directly Sensed Errors

Most dryer error conditions are directly sensed by the system. From the schematics discussed above, it can be seen that each sensor is wired to its own digital input and in a series loop which terminates at the input of one of several hardware timers on the power 1/0 board. These hardware timers provide a second level of error detection for the system, as described above.

Whenever any safety switch opens, a 12 V Limit signal is removed from the input to one of the hardware timers. This causes the timer to begin timing. When the timer times out, as described above, all electrical power to the triacs and relays is disabled. These hardware timers provide a second level of error detection for the system.

As mentioned above, each digital input on the system is identical whether it is used for a safety input or a control switch. The input consists of a parallel to serial shift register and an input filter circuit consisting of a capacitor and two resistors. The filter section helps to reduce electrical noise at the input to the shift register and provides some electrical protection to prevent high voltages from damaging the 1/0 board if they are inadvertently connected to the safety circuits.

The digital inputs are designed so that a failure of the input or the safety circuit itself will shut the dryer down, not let it operate with an undetected error. In operation each input must sense the 12 Volt Safety Limit voltage as an indication that nothing is wrong. If the safety signal is missing for any reason such as an actual problem, broken wiring, or defective input components, the system will shut down the dryer and indicate the most probable cause of the error.

Safety Systems and Error Logging—Calculated Errors

Out of Grain conditions and metering roll failures are detected based on calculation done by the system. Out of Grain conditions, as described previously, are detected when the system determines that the load auger has run for some programmed length of time without generating an indication that the dryer is full of grain. This time is accumulated only when the load auger is being run in "automatic" mode and when grain is being discharged from the dryer.

The system responds to out of grain conditions in a slightly different manner than true errors. In most cases an error will cause an immediate shutdown of all dryer function. When the system detects an out of grain condition, the dryer operations are stopped but the unload auger is allowed to run through the unload delay or "cleanout" period before stopping.

Two types of metering roll failures can be detected. The first case is when the system has turned on the metering rolls but no rotation is sensed. This is accomplished by running a two minute timer any time the metering rolls are turned on. The countdown timer is contiguously reloaded anytime a pulse is received from either metering roll sensor 39*d*. If no pulses are received for two minutes the timer will expire and an error condition will expire and an error condition will shut down the dryer 1. The timer is stopped anytime the system shuts off the metering rolls 39 in the course of normal operation.

The second type failure is detected when the number of pulses coming from each sensor 39*d* are not roughly the same. Since the two rolls 39 are mechanically coupled, the number of pulses received from each sensor should be approximately the same. Once each second the system compares the accumulated pulses and if they are not within fifteen pulses (¼ RPM) of one another, computer 219 causes the dryer 1 to shut down.

Safety Systems and Error Logging—Error Logging Functions

A unique feature of the system is the ability to capture a historical record of errors that have caused dryer shutdowns. This error history is stored in the TIC and is available to users and service technicians to assist in rapidly identifying dryer problems even when shutdowns may have occurred when no one was present to see what the dryer was doing at the time of the problem. The TIC is used to store the date, time, and cause of the last twenty-five dryer shutdowns.

Each time the system detects a problem, it writes a record to the non-volatile memory TIC that include time and date information as well as a unique ID code that indicates the nature of the error that occurred. Up to twenty-five such records are retained at any one time. When the twenty-sixth error is encountered, the oldest error record is discarded and the newest added to the history. It should be understood that the number twenty-five is somewhat arbitrary, and that other numbers of errors could be stored as desired depending upon the amount of non-volatile memory available.

The error history may be viewed by the operator at any time. When the history is displayed the most recent error is shown first. Based on the error code stored in the record, the system displays an easy to understand, plain text message along with the time and date it occurred. The user may use the increase and decrease switches 149, 151 on the control panel 73 to scroll forward and backwards through history.

Miscellaneous System Features

The dryer system includes several notable features that aren't related to any particular function. These general features are described here.

Hour Meter

The system incorporates a software generated run time meter. This accumulates the mount of time, in hours and minutes, that the dryer has actually processed grain. This method differs from traditional hour meters that accumulated time anytime the device is turned on. This gives a much truer indication of how much the grain dryer has been used. The user/operator may view the total hours by pressing increase switch 149 at any time during operation (other than when another function requiring the increase switch is being performed).

Emergency Cooling

The safety system of the dryer shuts down all operation when a problem is detected. If the system determines the cause of failure to be one of the grain temperature related safeties, it will allow the user to manually restart the fans to cool the overheated grain. During this time the other safeties are still tested to detect other non-heat related problems.

The system will only allow emergency cooling to occur for sixty minutes. At the end of that time the dryer will again stop. If the system detects that the grain has cooled before the sixty minutes has elapsed, it will exit the cooling mode and stop the fans to conserve electricity. For safety reasons the dryer never starts except under direct command of the user when the start switch is pressed.

Service Bypass Functions

The system includes features that allow service technicians to instruct the computer to ignore no airflow indications in the fan housings and meter roll system problems. In many cases it is not possible to diagnose heater problems unless the airflow system is bypassed. The metering roll errors can be bypassed since they are not safely related and only effect the systems ability to calculate the amount of grain processed.

Data Retention on Loss of Electrical Power

If the electrical power to the dryer is lost while the system is operating, the user can resume dryer operation where it left off once power is restored. This feature is possible because as a course of normal operation, the values of all running batch times, etc. are stored to the non-volatile memory TIC once each minute. Any time the dryer controls are turned on, the timer values are reloaded with the data stored in this non-volatile memory. When the user depresses the start switch the dryer will restart and continue timed operations from where it left off, accurate to within one minute. The saving of the timer data is scheduled by the background processing and executed in the foreground once each minute.

Out of Grain Timer Setup

The out of grain timer controls the amount of time the dryer will attempt to load grain before it decides there is no more grain to be processed. To assist the operator in setting this value the dryer keeps track of how long it took to fill the dryer during the previous load operation. When the user presses the switch to set or check the timer value this length of time is displayed both in actual minutes (to the nearest 1/10) and as a percentage of the programmed out of grain time. This information makes it very easy for the user to determine if he should shorten or lengthen the time period.

Bushels Per Hour Calibration

The type of grain being dried and slight variations in the mechanical tolerances of the dryer can cause the calculated total bushels of grain processed to be inaccurate. The BPH Calibration Factor can be programmed by the user to compensate for these variations. Under software control it allows a range of ±99% change in the calculated value of grain processed.

Total Bushels Counter

The total bushels counter is incremented each time enough meter roll pulses have been accumulated to indicate that a bushel of grain has been processed. This amount is adjusted by the calibration factor described above and can be reset to 0 by the user. The feature is useful for estimating the amount of grain harvested from a particular field or the amount processed for a given customer.

Help Prompts

Setup and operation of the computer controlled grain dryers is made easy through the use of plain text help screens for every setup function. Whenever the user is required to press a switch or change some data value, a message is displayed with instructions on how to perform the operation. Before actually making any change, the user is always asked to confirm he wants to make the change and is given the opportunity to abort without changing a parameter.

Other Features

Memory U3 has stored therein the programs for a variety of sizes or models of grain dryers. This permits the same control board to be used in a multitude of different grain dryers. The user accesses the different programs by pressing switches 149 and 151 at the same time. In response, the computer guides the user through the process of selecting the proper program for the particular dryer 1 in which the control circuitry of the present invention is installed. Note that since the model of dryer is displayed in display 119 upon startup, this feature allows the user or a technician to verify that the proper software program for the particular model dryer involved is enabled. The same input, actuation of switches 149, 151, allows the user to change the amount of time delay between the starting of the fans, and allows the user to instruct the control circuitry to ignore certain inputs such as the air pressure switch inputs and the metering roll sensor inputs. Such operation might be necessary in the event certain of these sensors fail, for example. In addition, the computer is responsive to a predetermined input to reset all timers to a preset amount. This allows a user who has made a mistake in setting the timers to totally reset the system readily and easily.

Note as well that the computer allows the viewing of timer and time delay settings, the changing of these values, and the viewing of the shutdown log on display 119 without interrupting dryer operation. These tasks are handled simultaneously. The shutdown log messages are specific so that the service technician or user knows exactly which condition has shut down the dryer. An illustrative list of such messages and their meaning is as follows:

"L1 Voltage Lost"—corresponding circuit breaker tripped or hardware timer timed out "12 Volt Power Supply Warning"—corresponding circuit breaker has tripped "Motor Overload"—thermal overload on a fan motor, load motor, unload motor, or auxiliary motor has opened "Burner 1 Vapor High Temperature"—sensor associated with that burner has indicated that the temperature for that vapor is too hot "Burner 1 Warning Flame Not Detected"—flame sensor associated with that burner has failed to detect a burner flame indicating that the burner has failed to light, that there is a problem with the time sensing circuitry, or that the dryer is not getting burner fuel "Fan 1 Housing High Temperature"—temperature high limit sensor located on the fan/burner housing has opened indicating an over temperature condition has occurred towards the rear of the fan/heater housing "Grain Discharge Warning"—the cover of the grain discharge box has opened indicating that grain is backing up into the discharge box "Lower Adj. Grain High Temperature"—an over temperature condition has occurred inside the left side grain column "Lower Fixed Grain High Temperature"—an over temperature condition has occurred inside the right side grain column.

"Out of Grain—Unload Cleanout"—the dryer has run low on grain and the out of grain timer has timed out, shutting the dryer down.

"Plenum 1 High Temperature"—an over temperature condition has occurred inside the particular dryer plenum "Meter Roll Drive System Failure"—the metering roll drive system has failed to start turning, indicating a faulty d.c. motor, a broken chain, or a jammed roll "Right Metering Roll Failure"—the right metering roll has stopped rotating or the sensor has been damaged "Left Metering Roll Failure"—the left metering roll has stopped rotating or the sensor has been damaged "Auxiliary Safety Shutdown"—a shutdown has occurred due to a user-installed safety feature.

"Burner 1 Shutdown—Loss of Airflow"—the air switch contacts have opened indicating insufficient air flow for the corresponding burner to operate.

"Fan 1 Failure—No Airflow"—the air switch contacts have opened indicating the fan may not be turning.

"Fan 1 Cannot Start—Check Air Switch"—the air switch contacts have closed prior to the fan starting, indicating a freewheeling blade or improper setting of the air switch.

In addition to preventing any two fans from coming on at the same time, computer 219 is programmed to prevent the possibility of any two motors in general from being started at the same time. This keeps peak current demands as low as possible.

The control circuitry, generally as heretofore described, is usable with a multiplicity of combination grain dryers, as shown in FIGS. 1 and 2. For example, such a controller is used without modification by Grain Systems, Inc., the assignee of the present invention, to control over sixty (60) different models of such grain dryers. Upon installing a controller in a dryer, the relevant software for that model is enabled as described above. The proper software thus programs computer 219 to control the proper number of burners, fans, and sensors so as to properly operate the particular dryer in which it is installed. By being able to use the same computer controller on a wide number of grain dryers, inventory problems during manufacture of the grain dryer are greatly reduced. Likewise, in field servicing of the dryers, only a single controller need be stocked as a replacement part for all such dryers that possibly may need to be serviced.

Figure 22:
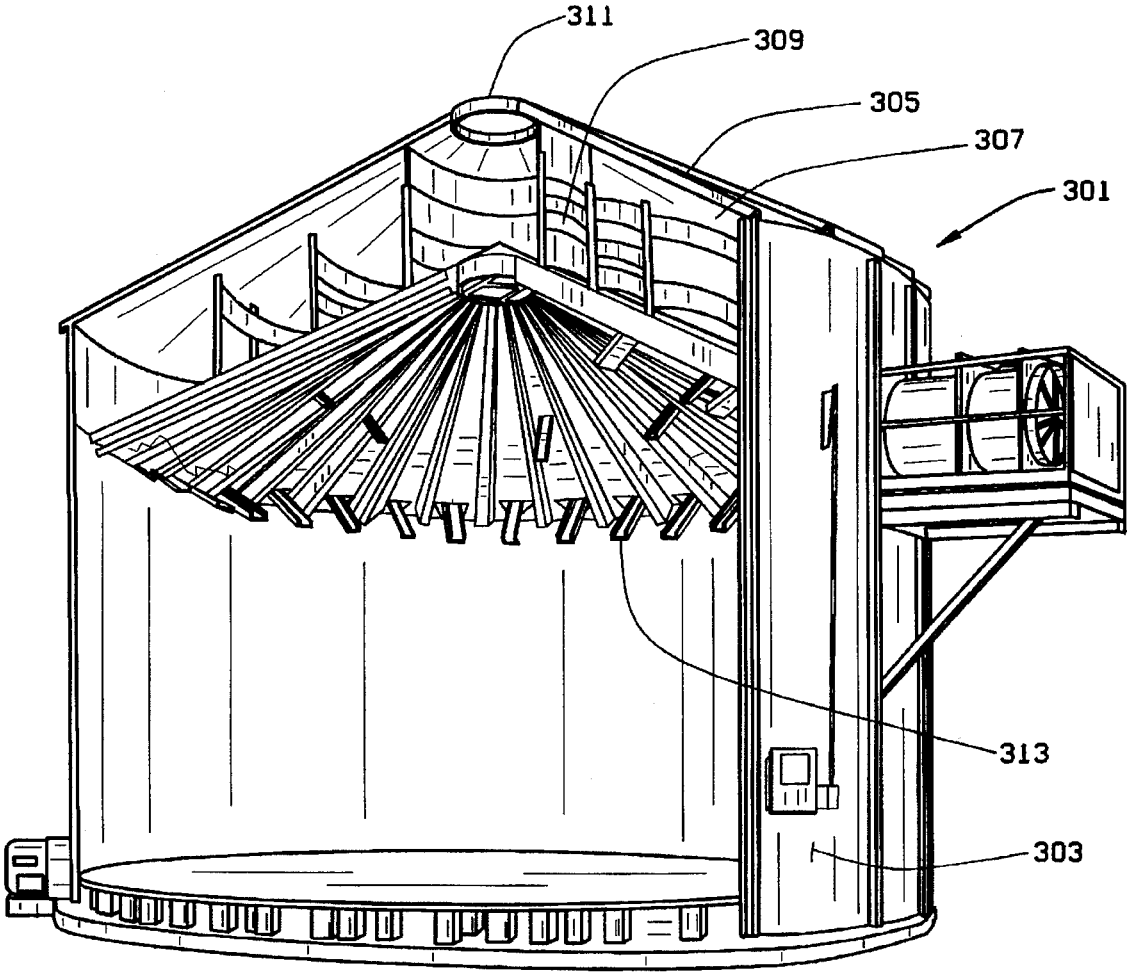
FIG. 22 is a perspective view with parts cut away for clarity illustrating a batch bin grain dryer controlled by the computerized control circuit of the present invention.

Further, it will be understood that the computer controller of the present invention may be used (as modified by software changes only) to control grain dryers and other implements other than the combination dryers above-described, as shown in FIGS. 1 and 2. For example, the computer controller of the present invention may be used to control a so-called batch bin dryer, as indicated in its entirety at 301 in FIG. 22. Such batch bin dryers are commercially available from Grain Systems, Inc. of Assumption, Ill., under the trade designation "Top Dry" grain dryer. More particularly, batch bin dryer 301 comprises a grain bin 303 having cylindrical sidewalls 305 and a conical roof 305. A conical drying floor 307 is mounted in the upper portion of the bin below roof 305. A conical drying floor 307 is mounted in the upper portion of the bin below roof 305. The drying floor has grain leveling shields 309 thereon. The roof 305 had a center opening 311 through which wet grain to be dried is loaded into dryer 301. The grain falls onto the apex of the drying floor and flows down the sloped drying floor to form a uniform layer of grain to be dried. Of course, the grain leveling shields 309 insure that a uniform layer of grain to be dried is formed on the upper face of the drying floor. This layer of grain on the drying floor is analogous to grain column GC heretofore described in regard to grain dryer 1. Drying floor 307 is of perforate construction so as to allow heated air from below to flow through the floor and through the grain supported on the floor for drying the grain. The bin 301 has a fan/heater unit 49 (as above-described) mounted on the bin sidewall 303 somewhat below the conical grain drying floor. The fan/heater unit supplies heated air under pressure into the interior of the grain bin beneath the drying floor. The drying floor is provided with a plurality of selectively operable doors 313 which when closed maintain the grain of the upper surface of the drying floor and which when opened, allow the dried grain to fall into the lower reaches of the bin thus allowing another batch of set grain to be loaded on the drying floor. The doors 313 thus constitute means for controlling the flow of grain along the path of the grain as it is moved through batch bin dryer 301. A number of sensors are located through the bin and the fan/heater unit 49 to monitor various temperatures and other conditions which indicate the status of the grain being dried. In accordance with this invention, the controller of the present invention, as above-described, may be used (as modified by suitable software modifications as will be apparent to those skilled in the art, especially in view of the above description of the controller) to control and monitor operation of bin batch dryer 301, as above described.

Still further, the computer controller of the present invention may be used to control operation of conventional grain bin dryers using a fan/heater assembly 49 to supply heated air into a plenum beneath a perforated, horizontal drying floor in the bottom of the grain bin and to control grain stirrers and the like. Also, the controller may be used to control so-called tower grain dryers.

It should also be understood that the present invention is not limited to a stand-alone grain dryer. The control circuitry of dryer 1 may readily be connected through a suitable communications channel 319 to a computer 321 disposed in the user's home or office 323 so that the user may monitor the grain dryer operation from that remote location. Since computer 219 in the grain dryer has stored therein all the switch positions and all triac and relay closure information, that information is readily transmittable to the home computer 321 for suitable display to the user. This display is updated as the switches and triac/relay closures are changed.

A typical display would be:

Unload Switch: 1 Speed

Metering Rolls: On

Unload Auger: On

RPM: 7.9

Bushels Per Hour: 990

Other information would include burner and fan status, etc.

The home computer 321 also monitors the safety circuit information. Each time a safety shutdown occurs the problem, time, and date are logged into the memory of computer 321. Note that the number of safety shutdowns which computer 321 can record is not limited to the twenty-five recordable by computer 219. If desired this information can be printed out on a printer. In addition, a modem can be used to communicate over telephone lines 325 so that the shutdown information can be transferred to a remote site 327 such as the factory where technical support is available. This enables more rapid and accurate diagnosis of any problems with the operation of the dryer. Of course, the modem could be actuated automatically in the event of a shutdown, if desired.

In view of the above it will be seen that the various objects and features of the present invention are achieved and other advantageous results obtained. The description of the invention contained herein is illustrative only and is not to be taken in a limiting sense. The invention is limited only by the claims which are appended hereto.

What is claimed is:

1. A grain dryer comprising:

a housing defining a path for grain to be dried;

a fan and heater assembly for supplying heated air to the path for drying grain the path;

a plurality of sensors for sensing different fault conditions, at least one of said sensors being disposed to detect airflow from the fan and heater assembly;

control means responsive to the sensor for controlling operation of the fan and heater assembly to initiate a shutdown procedure upon the indication of a fault condition, said control means being responsive to the airflow sensor to initiate the shutdown procedure only when the indication of an airflow fault condition continues for a predetermined time.

2. The grain dryer as set forth in claim 1 wherein the predetermined time is approximately two seconds.

3. A grain dryer comprising:

a housing defining a path for grain to be dried;

a fan and heater assembly for supplying heated air to the path for drying grain in the path, said fan and heater assembly having a fan and a heater, said fan being operable independently of the heater;

a plurality of sensor for sensing different fault condition, at lease one of said sensors being disposed to detect airflow from the fan and heater assembly;

control means for controlling operation of the fan and heater assembly, said control means being responsive to the sensor to initiate a shutdown procedure upon the indication of a fault condition, said control means being responsive to the airflow sensor to start the fan only when the airflow sensor indicates no airflow from the fan and heater assembly, said control means being further responsive to the airflow sensor to start the heater only if the airflow sensor indicates the flow of air from the fan and heater assembly within a predetermined length of time after the fan is started.

4. The grain dryer as set forth in claim 3 wherein the predetermined length of time is approximately twenty seconds.

5. The grain dryer as set forth in claim 3 wherein the control means initiates the shutdown procedure if the airflow sensor indicates lack of airflow from the fan and heater assembly before the fan is started.

6. The grain dryer as set forth in claim 3 wherein the control means initiates the shutdown procedure if the airflow sensor indicates lack of airflow from the fan and heater assembly within the predetermined length of time after the fan is started.

7. A grain dryer system comprising:

a housing defining a path for grain to be dried;

a fan and heater assembly for supplying heated air to the path for drying grain in the path;

means for controlling the flow of grain out of the housing;

means for sensing fault conditions associated with the drying of the grain;

a controller operatively connected to the sensing means for controlling operation of the dryer and for initiating shutdown procedures in response to fault condition; and means for communicating identifying information concerning fault conditions between the controller and a site remote from the dryer, wherein the communicating means includes telecommunications means for communicating with the remote site via telephone lines.

8. A grain dryer comprising:

a housing defining a path for grain to be dried such that said grain is dried as the grain moves along said path;

a fan and heater assembly for supplying heated air to the path for drying grain in the path;

means for controlling the flow of grain along said path;

a plurality of sensors disposed in predetermined positions so as to detect a plurality of different fault conditions, said sensors generating a plurality of corresponding fault signals in response to the detection of said fault conditions;

a controller operatively connected to the sensors, said controller being responsive to said fault signals to initiate a predetermined shutdown procedure upon receipt of any one of said fault signals;

a memory operatively connected to said controller for electronically recording identifying information concerning shutdown procedures initiated by the controller; and said controller having means for controlling start-up of said dryer in a predetermined manner.

9. The grain dryer as set forth in claim 8 wherein the identifying information recorded in the memory includes the identity of the sensor which detected a fault condition.

10. The grain dryer as set forth in claim 8 wherein the controller includes a clock and wherein said identifying information recorded in the memory includes the time at which the corresponding fault signal occurred.

11. The grain dryer as set forth in claim 8 wherein the controller includes means for controlling the memory to store identifying information in memory for a predetermined number of shutdowns initiated by the controller.

12. The grain dryer as set forth in claim 11 wherein the means for controlling the memory is under programmed control to keep the identifying information for the most recent shutdowns initiated by the controller.

13. The grain dryer as set forth in claim 8 wherein the memory includes a battery associated therewith to maintain the contents of the memory irrespective of whether external power is provided to the dryer.

14. The grain dryer as set forth in claim 8 further including a display device for displaying identifying information relating to shutdowns irrespective of whether the dryer is in operation.

15. The grain dryer as set forth in claim 8 wherein the identifying information stored in the memory for each different fault condition is unique.

16. The grain dryer as set forth in claim 15 wherein the unique identifying information is preprogrammed into the controller, said controller in response to receipt of a particular fault signal causing the corresponding unique identifying information to be stored in the memory.

17. The grain dryer as set forth in claim 8 wherein the controller is a computer under programmed control, further including a hardware timer independent of the computer for shutting down operation of the dryer after expiration of a predetermined time after receipt of any one of said fault signals irrespective of any action taken by said computer in response to said fault signal.

18. The grain dryer as set forth in claim 8 further including interface means for accepting fault signals from equipment external to the housing, said controller being responsive to said external equipment fault signals to initiate said predetermined shutdown procedure and to record corresponding identifying information in the memory.

19. The grain dryer as set forth in claim 18 wherein said corresponding identifying information indicates that the shutdown was the result of a fault signal originating from outside the dryer.

20. A grain dryer comprising:

a housing defining a path for grain to be dried;

a fan and heater assembly for supplying heated air to the path for drying grain in the path;

transport means associated with the housing for transporting grain;

a plurality of sensors for sensing a plurality of different fault conditions;

control means responsive to the input signals for controlling operation of the fan and heater assembly and the transport means to perform a drying cycle for the grain, said control means including a plurality of timers for measuring the time remaining in a plurality of portions of the drying cycle, said control means being responsive to the sensors to initiate a shut down procedure upon receipt of a signal from said sensors indicative of a fault condition, said control means being further responsive to receipt of said fault condition indicating signal to store the state of each timer so that upon a restart of the dryer the drying cycle may resume at the point at which the fault condition occurred.

21. The grain dryer as set forth in claim 20 wherein the control means includes a timer for keeping a running total of the time the dryer is in actual operation, said control means being responsive to a shutdown to stop said timer.

22. The grain dryer as set forth in claim 21 further including a plurality of manually operable switches for providing control information to the control means, said switches including a start switch to provide a start signal, said control means controlling the running total timer to begin adding time to the running total in response to actuation of the start switch only.

23. The grain dryer as set forth in claim 20 wherein the control means timers include dry, cool, and unload timers, said control means including means responsive to the dryer being in a batch mode of operation for obtaining a total dry time for a batch of grain by summing the times on said dry, cool and unload timers.

24. A grain dryer comprising:

a housing defining a path for grain to be dried;

a fan and heater assembly for supplying heated air to the path for drying grain in the path;

means for controlling the flow of grain out of the housing, said controlling means including at least one roll disposed along said path;

a controller operatively connected to the controlling means for controlling operation of the roll, said roll being rotatable in first and second directions, the controller controlling the roll to rotate primarily in the first direction and to rotate in the second direction on predetermined occasions, so that grain is prevented from building up excessively around the roll.

25. The grain dryer as set forth in claim 24 wherein the controller controls the roll to reverse direction of rotation at predetermined times.

26. The grain dryer as set forth in claim 24 wherein the direction of rotation of the roll is reversed for a predetermined length of time during predetermined periods of operation of the dryer.

* * * * *